US009220348B2

(12) United States Patent
Stieler et al.

(10) Patent No.: US 9,220,348 B2
(45) Date of Patent: Dec. 29, 2015

(54) APPARATUS AND METHOD FOR ERGONOMIC SUPPORT OF HUMAN SYSTEM INTERACTION

(71) Applicants: Richard Stieler, Vancouver (CA); Benjamin Moglin, Vancouver (CA)

(72) Inventors: Richard Stieler, Vancouver (CA); Benjamin Moglin, Vancouver (CA)

(73) Assignee: RAD LABORATORIES INC., Vancouver (CA)

( * ) Notice: Subject to any disclaimer, the term of this patent is extended or adjusted under 35 U.S.C. 154(b) by 0 days.

(21) Appl. No.: 14/357,763

(22) PCT Filed: Nov. 13, 2012

(86) PCT No.: PCT/CA2012/050803

§ 371 (c)(1),
(2) Date: May 12, 2014

(87) PCT Pub. No.: WO2013/067649

PCT Pub. Date: May 16, 2013

(65) Prior Publication Data

US 2014/0306075 A1 Oct. 16, 2014

Related U.S. Application Data

(60) Provisional application No. 61/558,598, filed on Nov. 11, 2011.

(51) Int. Cl.

| | |
|---|---|
| ***A47B 39/00*** | (2006.01) |
| ***A47C 7/68*** | (2006.01) |
| ***A47C 7/70*** | (2006.01) |

(52) U.S. Cl.

CPC .... *A47C 7/68* (2013.01); *A47C 7/70* (2013.01)

(58) Field of Classification Search

CPC ..... A47C 7/72; A47C 7/68; A47C 7/70; A47B 21/00; F16M 11/24; F16M 11/2021; F16M 11/18; F16M 11/10; F16M 2200/08

USPC ..... 297/217.3, 170, 172, 188.21, 217.1, 297/174 R

See application file for complete search history.

(56) References Cited

U.S. PATENT DOCUMENTS

| | | | | |
|---|---|---|---|---|
| 4,915,450 | A * | 4/1990 | Cooper | F16M 11/10 248/919 |
| 5,803,547 | A | 9/1998 | Brown | |
| 6,056,363 | A * | 5/2000 | Maddox | A47C 3/0257 297/115 |
| 6,296,408 | B1 * | 10/2001 | Larkin | A47B 83/001 400/681 |

(Continued)

FOREIGN PATENT DOCUMENTS

| | | |
|---|---|---|
| CA | 2418874 | 8/2004 |
| CN | 201208037 | 3/2009 |
| WO | 2008057618 | 5/2008 |

OTHER PUBLICATIONS

English Abstract of CN 201208037 which was published on Mar. 18, 2009 as made available from esp@cenet as of Nov. 6, 2014.

(Continued)

*Primary Examiner* — Todd M Epps
(74) *Attorney, Agent, or Firm* — Cameron IP

(57) ABSTRACT

A human interaction support apparatus for supporting a peripheral comprising means for defining a user area into which a user may be received and means for hanging a first peripheral from the means for hanging such that the first peripheral is in front of the user area.

4 Claims, 42 Drawing Sheets

(56) References Cited

U.S. PATENT DOCUMENTS

| | | | | |
|---|---|---|---|---|
| 6,354,044 | B1 | 3/2002 | Lagace, Jr. | |
| 6,916,065 | B2 | 7/2005 | Park | |
| 7,134,719 | B2 * | 11/2006 | Moglin | A47C 7/72 297/170 |
| 7,823,973 | B2 * | 11/2010 | Dragusin | A63F 13/08 108/50.01 |
| 8,141,949 | B2 * | 3/2012 | Baru | A47B 21/00 297/172 |
| 8,939,500 | B2 * | 1/2015 | Voigt | A47B 83/02 297/170 |
| 2004/0007907 | A1 * | 1/2004 | DiRe | A61C 19/00 297/217.3 |

OTHER PUBLICATIONS

WIPO, Canadian International Searching Authority, International Search Report mailed Apr. 24, 2013 in International Patent Application No. PCT/CA2012/050803, 3 pages.

WIPO, Canadian International Searching Authority, Written Opinion of the International Searching Authority mailed Apr. 24, 2013 in International Patent Application No. PCT/CA2012/050803, 5 pages.

* cited by examiner

APPARATUS AND METHOD FOR ERGONOMIC SUPPORT OF HUMAN SYSTEM INTERACTION

CROSS-REFERENCE TO RELATED APPLICATION

This application claims the benefit of provisional application 61/558,598 filed in the United States Patent and Trademark Office on Nov. 11, 2011 the disclosure of which is incorporated herein by reference and priority to which is claimed.

BACKGROUND OF THE INVENTION

1. Field of the Invention

This invention relates to an anthropotechnical system that is created in the bond of the physical environment supporting human system interaction, with purposeful utilization of the system devices.

2. Description of the Related Art

U.S. Pat. No. 7,134,719 which issued on Nov. 26, 2012 to Stieler et al. discloses a work station comprising a base and a user support affixed to said base. There is also an overhead hanger immovably affixed to said base. The overhead hangar has a rear portion extending upwardly behind said user support and an overhead portion extending forwardly above said user support a sufficient distance so that when a user is positioned in said user support said overhead portion is above said user. A peripheral mounting system affixable to said overhead portion proximate a distal end of said overhead portion. A horizontally disposed pipe is affixed to said base, a vertically oriented sleeve is affixed to a distal end of said pipe, and a rod is telescopically slidable and rotatable within said sleeve. The rod has a horizontal portion extending from a top end thereof and a computer mouse tray and a keypad tray. Each of the computer mouse tray and the keypad tray is independently positionable about said horizontal portion.

SUMMARY OF THE INVENTION

The invention relates to an apparatus with systems and system devices integrated therein. The invention further relates to ergonomics of the human optimally using the said systems and systems peripheral devices. The invention still further relates to the human system interaction in terms of achieving and maintaining proper ergonomics according to the "International Standards Organizations multipart standard 9241 titled Ergonomics of Human System Interaction".

In a first embodiment of the human systems interaction apparatus there is a primary structural hub to which all other apparatus structural members connect directly or indirectly. The primary structural hub is supported by support structural members attached to the primary structural hub at each corner at the proximal ends thereof. The support structural members may extend down at an angle of 133 degrees to connect to any surface at distal ends thereof.

The primary structural hub supports a primary systems hub attached to the underside of the primary structural hub. The systems peripheral devices are directly connected to the primary systems hub by an internal network of cables and wireless systems integrated within the human systems interaction apparatus disclosed herein. The peripheral systems devices are supported by multiple structural members connected directly, or indirectly, to the primary structural hub device allowing for the physical integration of cables, and wireless systems management. An anterior primary peripheral support structure is connected to the primary structural hub at the rear of the primary structural hub, and at the proximal end of the anterior primary support structure. The anterior primary support structure extends out from the rear and may bend upwards at an angle 120 degree and runs parallel to an ergonomic positioned users spine, neck, and head, to a sufficient distance as to have the distal end above and behind the head of the user. A macro hub support structure is attached to the distal end of the primary support structure.

The human systems interaction apparatus may include a plurality of visual display terminals VDT support structures that connect at the proximal end to the macro hub at the left or right or top. The VDT support structures extend out horizontally from the macro hub and bend perpendicular, then extend forward to a sufficient distance as to have the distal end positioned in front of the user at the maximum ergonomic ranges of VDT positioning. The apparatus may to position VDT(s) such that the ergonomic positioned user views without bending the neck or head. The VDT(s) may support directly in front of the user at or below eye level on a perpendicular angle. The apparatus may allow for the adjustability of angle and tilt of VDTs from 5 degrees to 30 degrees and within a viewing range of 450 mm to 1000 mm from the eyes of the user.

The human systems interaction apparatus may include a plurality of systems devices support structures that connect to the primary structural hub directly, and the anterior primary support structure along its entire length. The systems devices support structures proximal ends extend from the primary hub, and or, support structure, and some may have systems devices plates connected at their distal end. The systems devices plates are adjustable along the x, y, and z axis. Certain systems devices are supported by the system devices plates, and accordingly, may be arranged in the optimal ergonomic and bio mechanical position relative to the user. ISO 9241-3, Section 3, Application: A good work system shall meet the needs of the individual. This apparatus may be ISO 9241-3 compliant by providing adjustability.

The human systems interaction apparatus may support the human body in a reclined position with support along the entire body, including lower back or lumbar support. The apparatus may support the user's feet and lower legs with an adjustable footrest and calf supports providing for an approximate 110 degree bend at the knees. The user's shoulders and upper arms of the body may be in-line with the torso and may also be supported. The user's head and neck may be in-line with the torso, not bent forward, back, or to the side. The human systems interaction apparatus may allow the user's elbows to be supported along the sides of the body, with forearms supported and wrists straight. The apparatus may position the user's forearms, wrists, and hands in-line with forearms 90 degrees to the upper-arm. Systems devices within the apparatus may be positioned as to be operated in a relaxed and natural ergonomic position.

In a second embodiment of the human systems interaction apparatus there is a primary structural hub supported by structural members that rest on a surface or on wheels to be portable. There is a primary systems hub supported by the primary structural hub. Multiple support structures connect to the primary structural hub and there is a rear portion extending upwardly relative to a base thereof. At least one upper portion is connected to the rear portion. The upper portion extends above the base to a point spaced apart from the rear portion such that a user may be received in a user area between the point and the rear portion and between the base and the upper portion. The upper portion is configured to cooperate with a primary peripheral support structures for supporting a first peripheral from the upper portion, in front of the user area, to facilitate use of the first peripheral by a user in the user area. The human systems interaction apparatus may be scaled up or increase number of secondary peripheral support structures to support additional peripherals from the upper portion, in front of the user area, to facilitate use of the secondary peripheral by a user in the user area.

An input device support structure is connected to the base. The input device support has a tubular structure extending upward relative to the base and an option for placement on left or right side of the human systems interaction apparatus. At least one input support platform is connected to the input device support structure and extends above the base to a point spaced apart from the rear portion such that a user may be received in a user area between the point and the rear portion and between the base and the upper portion. The upper portion is configured to cooperate with the secondary peripheral support structures for supporting additional peripheral from the upper portion, in front of the user area, to facilitate use of the peripheral by a user in the user area.

The main support structure may be fixed relative to the base with the peripherals being adjustable on X, Y, and Z axes relative to the user in the user area. The input support structure may also be fixed relative to the base with input peripherals being adjustable on X, Y, and Z axes relative to the user in user area. The human systems interaction apparatus may still further include a chair mount to facilitate mounting a chair to the base.

The human systems interaction apparatus may further including a lock operable to lock the upper portion in a position relative to the rear portion. The rear portion may have an angled portion extending at an angle relative to the base and may have an upwardly projecting portion extending generally perpendicular to a surface on which the base rests. The upper portion may have a connecting portion operable to connect with the upwardly projecting portion of the rear portion and may have an outwardly projecting portion extending generally above the user. The outwardly projecting portion may having an outer end from which the first peripheral may be hung.

The human systems interaction apparatus may further include a first peripheral hanger with an outer end having a connector for connecting to a computer peripheral suspender. The hanger may include first and second hanger members each having a rear portion and an upper portion adjacent the rear portion. The rear portion of each hangar member may extend upwardly relative to the base and behind the user position. The upper portion may extend above the user position to facilitate hanging a second peripheral above and in front of the user position. The rear portions of the first and second hangar members may be generally parallel to each other.

The main support structure may include a computer mount, to facilitate mounting a central processing unit to the main support structure. The computer mount may have a holder operable to hold a wire extending between the first peripheral and the processor. The rear portion and the upper portion may have respective tubular walls which define the holder. Each of the tubular walls may have an opening to facilitate routing of the wire. There may be a cover cooperating with the base to conceal the central processing unit.

The human systems interaction apparatus may still further include a second peripheral holder operable to be connected to the hanger to hold a second peripheral in proximity to the user position to facilitate use of the second peripheral. The second peripheral holder may include a clamp operable to clamp onto the rear portion of the hanger. The rear and upper portions of the human systems interaction apparatus may be tubular and have openings to facilitate holding a wire extending between the second peripheral and a processor adjacent the base.

In a third embodiment of human system interaction apparatus there are numerous structural members that are able to be positioned according to quantitative parameters defined in ISO 9241 Human Systems Interaction. The human system interaction apparatus may provide for correct ergonomics and biomechanical function for the user. The human system interaction apparatus may provide improvement to the well-being, efficiency, and productivity of user. The human system interaction apparatus may support the user with no pressure points maintaining internal fluids circulation and nerve function. The human system interaction apparatus may allow for the correct ergonomic positioning of human and systems with the ability for adjustment in relation to one another as to remain ergonomically and bio mechanically constant. The human system interaction apparatus may be assembled from structural members in various configurations as to accommodate the various height, weights, widths, and needs of users. The human system interaction apparatus may be scalable for use by the 90 percentile of world population. The human system interaction apparatus may be scalable in terms of structural members to provide for adaptability in form for function.

There is also provided a method of supporting the peripheral comprising:

a) defining a user area into which a user may be received, between a base and an upper portion of a peripheral hanger and between an end of the upper portion and a rear portion of the peripheral hanger; and b) hanging the peripheral from the end of the upper portion such that the peripheral is in front of the user area.

The human systems interaction apparatus disclosed herein may prevent diseases and health risks directly attributed to improper long-term computer systems use. The human systems interaction apparatus disclosed herein may further aid in the healing process of diseases directly attributed to improper long term use of computer systems. The human systems interaction apparatus disclosed herein may still further allow for the implement interactive computing systems for human use.

BRIEF DESCRIPTIONS OF DRAWINGS

The invention will be more readily understood from the following description of the embodiments thereof given, by way of example only, with reference to the accompanying drawings, in which.

DESCRIPTION OF ITEMS

Figure 1A:
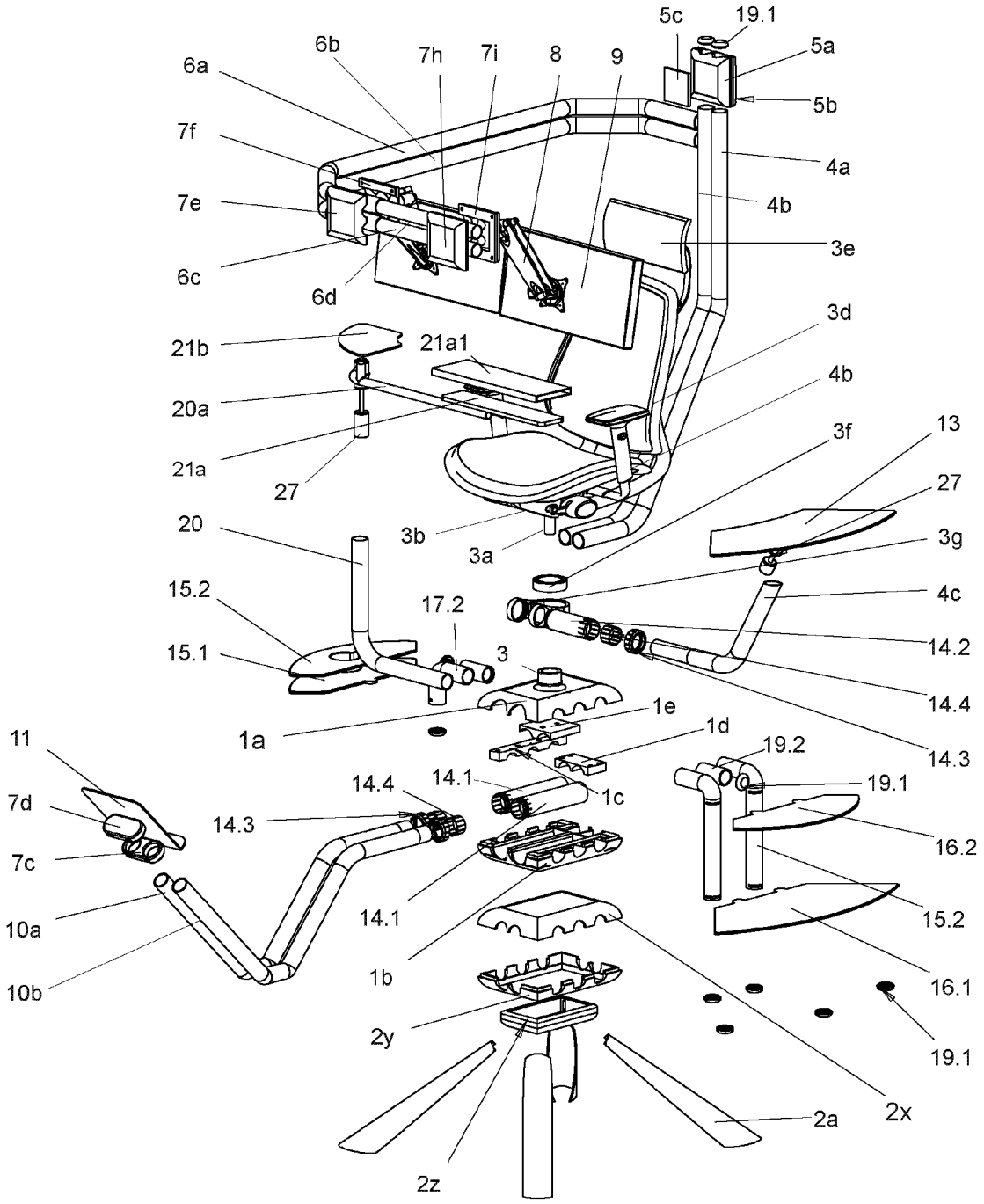
FIG. 1A is a perspective exploded view of an improved human systems interaction apparatus.

| ITEM | ITEM NAME | ITEM DESCRIPTION |
|---|---|---|
| 1a | Primary structural support hub half | Item 1a is an apparatus structural member defined as primary support hub, with Items 2a, 2b, 2c, 2d being equal in shape, material and vertical position as to provide primary support to the pyramidal base structure. Item 1a contains numerous internal structural support mechanisms which in turn provide scalability and expansion for the placement and securing of structural support members. |
| 1b | Primary structural support hub half | Item 1b is an apparatus structural member defined as primary support hub, which encloses the internal mechanisms of Item 1a by attaching to the mechanisms by way of screws. Item 1b also supports Item 3. |
| 1c | Clamp 1 (2 pieces) | Item 1c is a structural members defined as structural support mechanisms, which allows for the connections of Items 4a, 4b, 6c, 6d, 20a, 17.1, 17.2, to Item 1a respectively and uses bolts to tighten. |
| 1d | Clamp 2 | Item 1d is a structural members defined as structural support mechanisms, which allows for the connections of Items 4a, 4b, 6c, 6d, 20a, 17.1, 17.2, to Item 1a respectively and uses bolts to tighten. |
| 1e | Clamp 3 | Item e is a structural members defined as structural support mechanisms, which allows for the connections of Items 4a, 4b, 6c, 6d, 20a, 17.1, 17.2, to Item 1a respectively and uses bolts to tighten. |
| 2a | Leg | Items 2a, 2b, 2c, 2d are structural members defined as a legs being equal in length, shape and material as to provide support for the horizontal positioning of Item 1. Items 2a, 2b, 2c, 2d connect to the corners at the lower portion of Item 1. |
| 2b | Leg | Items 2a, 2b, 2c, 2d are structural members defined as legs being equal in length, shape and material as to provide support for the horizontal positioning of Item 1. Items 2a, 2b, 2c, 2d connect to the corners at the lower portion of Item 1. |
| 2c | Leg | Items 2a, 2b, 2c, 2d are structural members defined as legs being equal in length, shape and material as to provide support for the horizontal positioning of Item 1. Items 2a, 2b, 2c, 2d connect to the corners at the lower portion of Item 1. |
| 2d | Leg | Items 2a, 2b, 2c, 2d are structural members defined as legs being equal in length, shape and material as to provide support for the horizontal positioning of Item 1. Items 2a, 2b, 2c, 2d connect to the corners at the lower portion of Item 1. |

-continued

DESCRIPTION OF ITEMS

| ITEM | ITEM NAME | ITEM DESCRIPTION |
|---|---|---|
| 2x | Primary systems hub (top) | Item 2x and 2y are structural members defined as primary systems hubs, which house the internal components of the computer as well as the cooling system. Attaches to the bottom of Item 1 and is removable, once removed the internal components and systems wiring are accessed by opening the hood of Item 2. |
| 2y | Primary systems hub (bottom) | Item 2x and 2y are structural members defined as primary systems hubs, which house the internal components of the computer as well as the cooling system. Attaches to the bottom of Item 1 and is removable, once removed the internal components and systems wiring are accessed by opening the hood of Item 2. |
| 2z | Power supply hub | — |
| 3 | Piston receptacle | Item 3 is a structural member defined as a piston receptacle (lower support insert) which allows for the insertion and support of Item 3a. |
| 3a | Piston | Item 3a is a structural member defined as a piston which allows for the 360 degree rotation of the Item and supports the relative positioning of Items 3c, 3d, 3e, 3f. |
| 3b | Chair pan mechanism | — |
| 3c | Chair pan | — |
| 3d | Lumbar support | — |
| 3f | Bearing | — |
| 3e | Head and neck support | — |
| 3g | Utility support hub | Item 3g is a structural member defined as utility support hub which allows for the 360 degree rotation of Items 4c and Item 13. Item 3 attaches to and around Item 3 by way of an internally housed bearing and provides the structural support for Item 14.1. |
| 4a | Anterior primary support structure | Items 4a and 4b are structural members defined as primary support structures. Items 4a and 4b allows for the positioning of numerous support mechanisms along their respective entire lengths, as well as supporting Items 5a and 5b at its distal end. Items 4a and 4b are attached at their respective proximal ends through Item 1 and are secured by Item 1d. |
| 4b | Anterior primary support structure | Items 4a and 4b are structural members defined as primary support structures. Items 4a and 4b allows for the positioning of numerous support mechanisms along their respective entire lengths, as well as supporting Items 5a and 5b at its distal end. Items 4a and 4b are attached at their respective proximal ends through Item 1 and are secured by Item 1d. |
| 4c | Utility support arm | — |
| 5a | Marco hub A | Items 5a and 5b are structural support members defined as macro hub mechanisms which connects to Item 4a and 4b and allow for the connections and support of Items 6a and 6b respectively. |
| 5b | Macro hub B | Items 5a and 5b are structural support members defined as macro hub mechanisms which connects to Item 4a and 4b and allow for the connections and support of Items 6a and 6b respectively. |
| 5c | Micro hub C | Item 5c is a member defined as an insert. Item 5c houses an array of LED lights so as to permit illumination of a company logo. Item 5c may also house a plurality of switches that may or may not be part of the logo to control on/off functions for any number of integrated systems devices. |
| 6a | VDT monitor | Items 6a and 6b are structural members defined as VDT monitor support structures which connect to Item 5 at their respective proximal ends and provide support for Items 7e, 7f, and 7j that connect at their respective distal ends. Items 6a and 6b may also contain any number of omni-directional lights strategically placed as to provide direct illumination to user areas as defined by user. Items 6a and 6b may also support 7.1 by way of strategically placed threaded holes along its entire length allowing for the insertion of speaker support mounts, or arms. |
| 6b | VDT support monitor | Items 6a and 6b are structural members defined as VDT monitor support structures which connect to Item 5 at their respective proximal ends and provide support for Items 7e, 7f, and 7j that connect at their respective distal ends. Items 6a and 6b may also contain any number of omni-directional lights strategically placed as to provide direct illumination to user areas as defined by user. Items 6a and 6b may also support 7.1 by way of strategically placed threaded holes along its entire length allowing for the insertion of speaker support mounts, or arms. |
| 6c | Secondary monitor support structure | Items 6c and 6d are structural support members defined as secondary monitor support structures. Items 6c and 6d are pipes of a reduced diameter as to allow for the horizontal movement inside of Item 6 and for the connection of Items 7h, 71, and 7j to their respective distal ends. |
| 6d | Secondary monitor support structure | Items 6c and 6d are structural support members defined as secondary monitor support structures. Items 6c and 6d are pipes of a reduced diameter as to allow for the horizontal movement inside of Item 6 and for the connection of Items 7h, 71, and 7j to their respective distal ends. |
| 7a | Micro hub 1B | Items 7a and 7b are structural members defined respectively as micro hubs 1B and 1A. Items 7a and 7b provide structural support integrity and torque reduction of Items 6a and 6b, and, or, where needed as to provide support, scalability and expansion attributes to the apparatus. |
| 7b | Micro hub 1A | Items 7a and 7b are structural members defined respectively as micro hubs 1B and 1A. Items 7a and 7b provide structural support integrity and torque reduction of Items 6a and 6b, and, or, where needed as to provide support, scalability and expansion attributes to the apparatus. |
| 7c | Micro hub 2A (foot rest) | Items 7c and 7d are structural support members defined respectively as micro hubs 2A and 2B respectively. Items 7c and 7d support Item 11 (user foot rest support) and attach to Item 10 at the distal end of Item 10 by way of bolts. Items 7c and 7d also join Item 18 1 (detent hinge) to Item 11. |
| 7d | Micro hub 2B (foot rest) | Items 7c and 7d are structural support members defined respectively as micro hubs 2A and 2B respectively. Items 7c and 7d support Item 11 (user foot rest support) and attach to Item 10 at the distal end of Item 10 by way of bolts. Items 7c and 7d also join Item 18.1 (detent hinge) to Item 11. |
| 7e | Micro hub 3A single monitor mount A | Items 7e and 7f are structural support members defined respectively as micro hubs 3A and 3B, (single monitor mount A and single monitor mount B end cap). Members attach at the distal ends of Item 6a and 6b by way of bolts and are joined and held together by Item 7i so as to provide structural integrity for the placement of additional monitors. |
| 7f | Micro hub 3B single monitor mount B | Items 7e and 7f are structural support members defined respectively as micro hubs 3A and 3B, (single monitor mount A and single monitor mount B end cap). Members attach at the distal ends of Item 6a and 6b by way of bolts and are |

-continued

DESCRIPTION OF ITEMS

| ITEM | ITEM NAME | ITEM DESCRIPTION |
|---|---|---|
| | | joined and held together by Item 7i so as to provide structural integrity for the placement of additional monitors. |
| 7gA | Micro hub 4 double monitor locking mount dual monitor extension | Item 7gA and 7gB are structural support members defined as respectively as double monitor mount and monitor support lock. Together they provide for support and insertion of Items 6c and 6d and the locking of Items 6c and 6d. |
| 7gB | Monitor support lock | Item 7gA and 7gB are structural support members defined as respectively as double monitor mount and monitor support lock. Together they provide for support and insertion of Items 6c and 6d and the locking of Items 6c and 6d. |
| 7h | Secondary monitor mount A | Item 7h and 7i are structural support members defined as respectively as secondary monitor Mount A and B. Items 7h and 7i together with Item 7j provide the support for Item 8 and Item 9. Items 7h and 7i along with Items 6c and 6d provide for integration, positioning, and horizontal motion for additional monitor placement in to the apparatus. |
| 7i | Secondary monitor mount B | Item 7h and 7i are structural support members defined as respectively as secondary monitor Mount A and B. Items 7h and 7i together with Item 7j provide the support for Item 8 and Item 9. Items 7h and 7i along with Items 6c and 6d provide for integration, positioning, and horizontal motion for additional monitor placement in to the apparatus. |
| 7j | Monitoring mounting plate | Item 7j is a structural support member described as monitor mounting plate. Item 7j connects together multiple configurations of Items 7a, 7b, 7e, 7f, 7gA, 7h, and 7i so as to provide support for Items 8 and 9 respectively. |
| 8 | Monitor support arm | Item 8 is a structural support member defined as monitor support arm which attaches to Item 7j by way of bolts or screws and allows for the articulated movement and positioning of Item 9. |
| 9 | VDT Monitor | Item 9 is a VDT peripheral support apparatus. Item 8 is connected to the back of Item 9 using industry standard VESA mounts. |
| 10a | Secondary support structure | Items 10a and 10b are structural support members defined as secondary support structures which allows for the support, positioning and placement of user's feet and calves. Items 10a and 10b may include a secondary support function in the form of a wheeled, or castor support mechanism to allow for the connection of Item 10 to the ground. Integrated in to bottom of the structure and positioned in such as to provide additional integrity and stabilization to the structure. |
| 10b | Secondary support structure | Items 10a and 10b are structural support members defined as secondary support structures which allows for the support, positioning and placement of user's feet and calves. Items 10a and 10b may include a secondary support function in the form of a wheeled, or castor support mechanism to allow for the connection of Item 10 to the ground. Integrated in to bottom of the structure and positioned in such as to provide additional integrity and stabilization to the structure. |
| 11 | User foot rest support | Item 11 is a structural support member defined as user foot rest support which is positioned and attached at the distal end of Item 10 allowing for the comfortable support of a user's feet. |
| 12 | User calf support | Item 12 is a structural support member defined as user calf support which is positioned as to comfortably support the user's calves. Item 12 attaches to Item 7a, 7b along the entire length of Item 10. |
| 13 | Utility support table | Item 13 is a structural support member defined as utility support table which allows a user 3.0 USB connections and docking for a variety of portable peripheral systems devices. Item 13 has the ability to retract in and out of the users work space relative to user as needed, can also be used as a writing surface providing the much needed desk space lacking in most ergonomic workstations. |
| 14.1 | Compression fitting 1 | Item 14.1 is a structural support member defined as compression fitting 1 which allows for the, internal extraction and retraction of Item 4c. Item 14.1 functions in conjunction with Items 14.3 and 14.4 so as to provide support for Item 4c. Item 14.1 attaches to the side of Item 3g by way of threads. |
| 14.2 | Compression fitting 2 | Item 14.2 is a structural member defined as a compression fitting 2. Item 14.2 allows for the internal support, extraction and retraction of Items 10a and 10b. Item 14.2 works in conjunction with Items 14.3 and 14.4 as to provide support for Item 10. Item 14.2 attaches to the inside of Item 1 by way of Item 3. |
| 14.3 | Nut | Item 14.3 is a structural support member defined as a nut which allows for the positioning and locking of Items 10 and Item 4c to Items 14.2 and Item 14.1 respectively. |
| 14.4 | Teflon ring | Item 14.4 is a member defined as a Teflon ring which works in conjunction with Item 14.3 to lock Item 10a, Item 10b and Item 4c. |
| 14.5 | Teflon insert | Item 14.5 is a member defined as a Teflon insert which facilitates the ease of motion while adding to further the stabilization of Items 10a and 10b. Item 14.3 is attached to the proximal ends of Items 10a and 10b. |
| 14.6 | Teflon sleeve | Item 14.6 is a member described as Teflon sleeve which is used to facilitate ease of motion of Items 6c and 6d inside of items 6a and 6b. Item 14.6 may also be inserted in to Item 14.1 to assist Item 4c in the same manner. |
| 15.1 | Small table for drinking | Item 15.1 is a structural member defined as small table for drinking which supports liquid beverages by way of a cut out portion in the shape of a cup. The cut out portion allows for a glass, bottle or cup to be placed through so as to rest on the top of Item 15.2. Item 15.1 may also be made of moulded materials in such a way that a universal type of cup holder is either built, or moulded into Item 15.1. Item 15.1 is connected to Item 15.2 by multiple Items 15.3 that fasten from the bottom of Item 15.2 by way of screws. |
| 15.2 | Coffee table | Item 15.2 is a structural member defined as coffee table which provides additional support for liquid beverages by connecting to and below Item 15.1. |
| 15.3 | Posts assembly | — |
| 16.1 | Big table | Item 16.1 is a structural member defined as a big table which supports large peripheral support devices such as printers, scanners, and copiers below and to the side of user. Item 16.1 attaches to Items 17.1 by way of screws and attaches to the floor by way of Item 19.1. |
| 16.2 | Small table | Item 16.2 is a structural member defined as small table which is positioned above Item 16.1 and to the side of a user. Item 16.2 supports various items utilized by user in a work environment. Item 16.2 attaches to Item 17.1 by way of screws. |
| 16.3 | Post assembly | Item 16.3 is a structural support members defined as post assembly which is a hollow aluminum tube that couples Item 15.2 to Item 15.1 by way of screws. |

-continued

| DESCRIPTION OF ITEMS | | |
|---|---|---|
| ITEM | ITEM NAME | ITEM DESCRIPTION |
| 17.1 | Table support (big and small) | Item 17.1 is a structural support member defined as table support (big and small) which connects at its proximal end to the inside of Item 1 and are held in place by Item 1c. Item 17.1 provides the structural support for Items 16.1 and 16.2. |
| 17.2 | Table support for double table for drinking/coffee | Item 17.2 is a structural support member defined as Table support (for double table/drinking/coffee) which connects at its proximal to the inside of Item 1 and is held in place by Item 1c. Item 17.2 provides structural support for Items 15.1 and 15.2. |
| 18.1 | Detent hinge (foot rest) | Item 18.1 is a positioning mechanism defined as detent hinge (foot rest) which allows for the positioning of Item 11 relative to the user. Item 18.1 connects Item 11 to Item 7c (micro hub 2a) with screws. |
| 18.2 | Detent hinge (utility) | Item 18.2 is a positioning mechanism defined as detent hinge (utility) which allows for the positioning of Item 13 (utility support table) to be flipped up and out of the way of the user when Item 4c rotates and assumes the profile of Items 4a and 4b. Item 18.2 connects Item 4c to Item 13 directly, or, to the internal mechanism housed inside of Item 4c. |
| 19.1 | Foot plug | Item 19.1 is a member defined as foot plug which connect to the underside of Item 16.1 and supports Item 17.1 to the floor. |
| 19.2 | Universal plug and pipe | Item 19.2 is a member defined as universal plug and pipe which together they cap the ends of any unused expansion receptacles found in Items 1 and Items 5a and 5b. Individually the universal plug connects to the distal ends of Item 17.1 and Item 17.2. |
| 20 | Keyboard support arm | Item 20 is a structural member defined as keyboard support arm which connects at is proximal end to Item 1 and is held in place by Item 3. Item 20 supports Item 20a at its distal end either directly, or, to the internal mechanisms housed inside of Item 20. |
| 20a | Swivel arm support | Item 20a is a structural member defined as swivel arm support which supports Items 21a and 21b. Item 20a allows for adjustability and positioning relative to user. |
| 21a | Peripheral systems devices plates | Item 21a is a member defined as peripheral systems devices plates which attaches to Item 20 along its entire length allowing for the support, and correct static positioning of Item 21a1 in relation to a user. |
| 21a1 | Integrated keyboard tray | Item 21a1 is a member defined as an integrated keyboard tray which supports the keyboard and provides the internal housing for a multitude of systems devices. Item 21a1 also supports external connections for USB 3.0 and provides additional storage for cd 5. |
| 21b | Peripheral systems devices plates (mouse pad) | Item 21b is a member defined as peripheral systems devices plates (mouse pad) which provides support for a mouse, track balls, optical pens and pointers etc. while allowing for adjustability and correct static positioning of the Item relative to the user. |
| 22 | Step | Item 22 is a structural member defined as a step. Seen in an alternative embodiment shown at Image Z, Item 22 supports Items 2a, 2b, 2c, and 2d at their respective distal ends and allows the user to step up, or, step out of the apparatus when multiple monitors are present. |
| 23 | Gas piston monitor support arm | Item 23 is a structural support member defined as gas piston monitor support arm. Seen in an alternative embodiment shown at Image V, Item 23 allows for the articulated movement along the X, Y, Z axis and static positioning of Item 9 relative to user in user area. |
| 24 | Structural support vibration dampener | Item 24 is a structural support member defined as structural support vibration dampener. Seen in an alternative embodiment shown at Item 24 connects at its proximal end to the internal mechanical components of Item 20, or, in such a way as to be inserted in to and or, sit on top of Item 20 and be secured by way of micro hubs, clamps, screws, or inserts. Item 24 does not interfere with the internal mechanical components or functions of Item 20 while extending upward to connect to Item 6. It is the intent of this embodiment to minimize vibrations associated with supporting large cumbersome monitors |
| 25 | Speaker support mounts | Item 25 is a structural support member defined as a speaker support mount which supports and positions speakers. |
| 26 | Elbows (various sizes) | Item 26 is a structural support member defined as an elbow. |
| 27 | Gas piston | Item 27 is a gas piston which allows vertical movement of the chair pan |

DESCRIPTIONS OF THE PREFERRED EMBODIMENTS

Referring to the drawings and first to FIGS. 1 to 5, an improved human systems interaction apparatus and components thereof are shown. Various features of the several different embodiments of the invention described herein may be used and assembled in combination with other features described herein to produce combinations of features other than those specifically described herein and such combinations are intended to be within the scope of this invention.

The improved systems interaction apparatus includes a primary structural support hub 1 which has two primary structural support hub halves 1*a* and 1*b*. The primary structural support hub is a structural member and is made of material as to provide structural rigidity. Proximal ends of legs 2*a*, 2*b*, 2*c*, and 2*d* may connect to primary structural support hub 1 at the radial corners of primary structural support hub 1. In this example, each of the legs 2*a*, 2*b*, 2*c*, and 2*d* connects to the primary structural support hub 1 at a 132 degree angle and may extend downwards 588.80 mm creating a 0.82 $M^2$ total area. Distal ends of legs 2*a*, 2*b*, 2*c*, and 2*d* are operable to rest on a support surface, connect to castors or wheels, or connect to alternate support surface at 48 degree angles creating a distance of 294.12 mm from the surface to the underside of the primary structural support hub 1. Connection of the legs 2*a*, 2*b*, 2*c*, and 2*d* to the primary structural support hub 1 are the primary support structural members of the apparatus and in combination provide structural rigidity for the apparatus.

The primary structural hub halves 1*a* and 1*b* are the main structural members of the primary structural support hub 1. However, the primary structural support hub also includes clamp members 1*c*, 1*d*, and 1*e* which are internal structural members of the primary structural support hub 1. The clamp members 1*c*, 1*d*, and 1*e*, allow for the adjustments and connection of numerous apparatus structural members of the apparatus to the primary structural support hub 1. The primary structural support hub 1 may have threaded members or other clamping devices to securely attach apparatus structural members to the primary structural support hub 1 and may prevent rotational movement and provide to the structural integrity of the apparatus structural members.

An internal volume or hollow of the primary structural support hub 1 allows for the systems cable management and integration of numerous power and data cables including, but not limited to, Fiber Optic, VGA, DVI, S-Video, RCA, ATA ATA1 50 USB cables, Firewire (IEEE1 394) PS-2 cables, Serial Cables SCSI cables, RJ-45 cables, coax cable, printer cable, and speaker cable.

Figure 7:
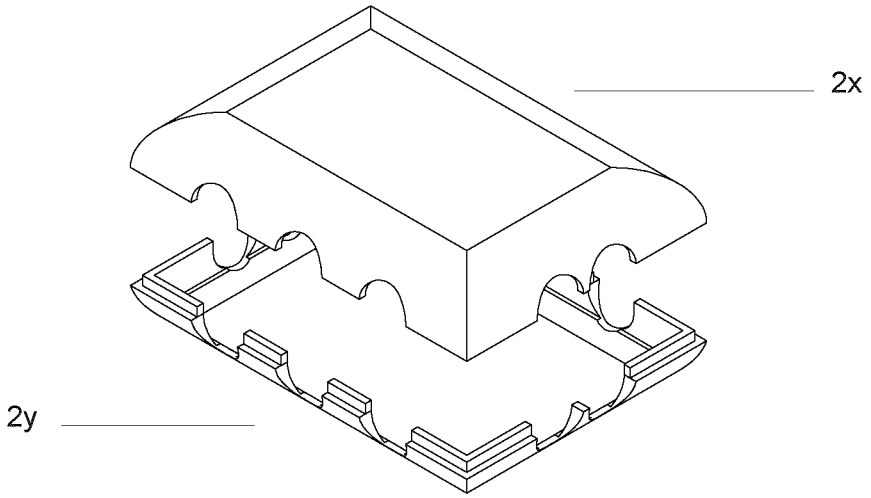
FIG. 7 is a perspective, exploded view of a primary systems hub of the human systems interaction apparatus of FIG. 1.

Referring back to FIGS. 1A and 1B, there is also a primary systems hub 2 which has two primary systems hub halves 2Y and 2X which are best shown in FIG. 7. The primary systems hub 2 is affixed to the primary structural support hub 1 by way of a bolt, screw, hinge, or sliding mechanism on the underside of primary structural support hub 1. The primary systems hub 2 has a plurality of system components internally to which circuit boards, containing Multiple Central Processing Unit, Random Access Memory, expansion slots, Digital Signal Processing Units, audio processing unit, video processing unit, digital input ports and other systems components are connected. Systems components may include flash drives, hard drives, optical drives, sensors, and other internal systems components, or generally any signal or data processing system device that employs system peripherals. Sufficient air circulation about the internal system components of primary systems hub 2 may be induced by multiple fans. The primary systems hub 2 may be attached to primary structural hub 1 immediately adjacent a first and lower end portion of the primary structural hub 1 and defines the space on the underside and sides of the human systems interaction apparatus and lower portion of primary structural hub 1. This is generally below a user.

Figure 8:
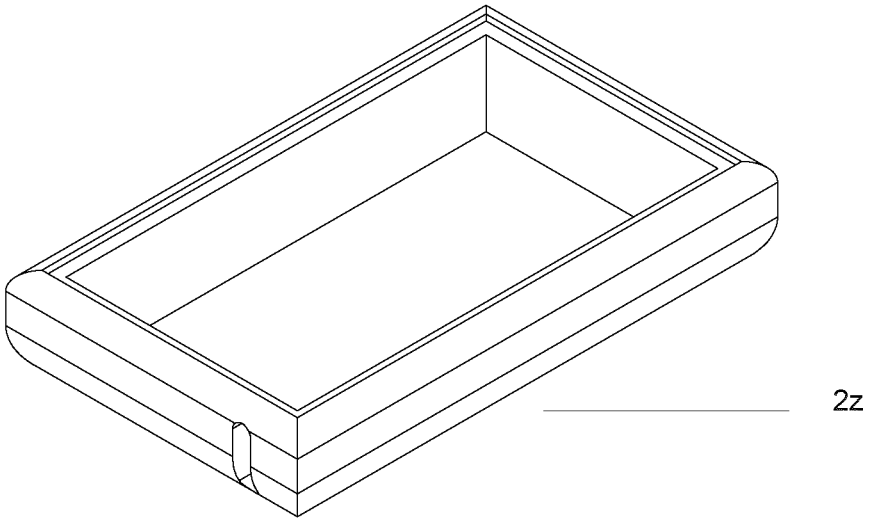
FIG. 8 is a perspective view of a power supply hub of the human systems interaction apparatus of FIG. 1.

There is also a power supply hub 2*z* which is best shown in FIG. 8. Referring back to FIGS. 2A and 2B, the power supply hub 2*z* may be attached to the underside of the primary systems hub 2 by way of bolt, or screw or sliding mechanism immediately adjacent the first and lower portion of the primary systems hub 2 which further defines space on the underside and sides of the apparatus. The power supply hub 2*z* dimensions may be 254 mm wide×355.600 mm long×44.450 mm or up to 650 mm deep. The power support hub 2*z* internal volume allows for a plurality of systems components to be housed which supply power to the internal or external components of the primary systems hub 2. The power supply hub 2*z* may house a power supply unit that is fitted in such a way as to exhaust air down and out through the bottom. The power supply hub may 2*z* may further contain a rotating mechanism that allows for a power cord to extend a distance of, for example, seven feet in an outward direction for connection to a power source when in use but also has the ability to re coil back into the systems power supply hub when not in use. On one side of power supply hub 2*z* there may also be internally housed are up to six power outlets providing external 110*v* power connections for a multitude of peripheral support devices. Three of these external outlets could be switched meaning devices plugged in are on when the computer is on and three could be un-switched meaning connected power must be switched on and off manually. External breaker switches could further provide Additional surge protection and could be mounted either on the side or on the bottom of power supply hub 2*z*. The power supply hub 2*z* may also contain up to eight external USB 3.0 outlets that could be fitted on the same or opposite side in the same fashion. It is the intent of this apparatus to provide the primary power for the primary systems hub while separating the power supply from the systems hub. Item 2*z* may supply secondary 110 v power and USB 3.0 connections to systems peripheral support devices.

Figure 19:
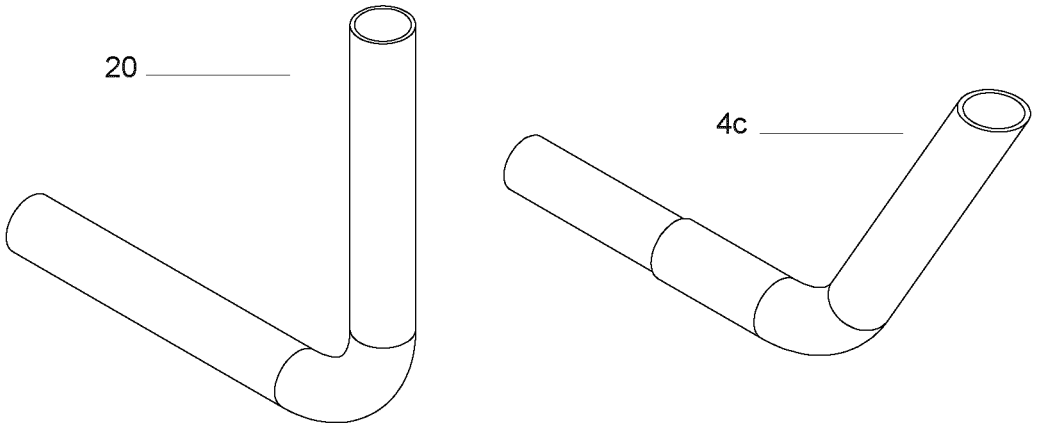
FIG. 19 is a perspective view of keyboard support arm and utility support arm of the human systems interaction apparatus of FIG. 1.
Figure 20:
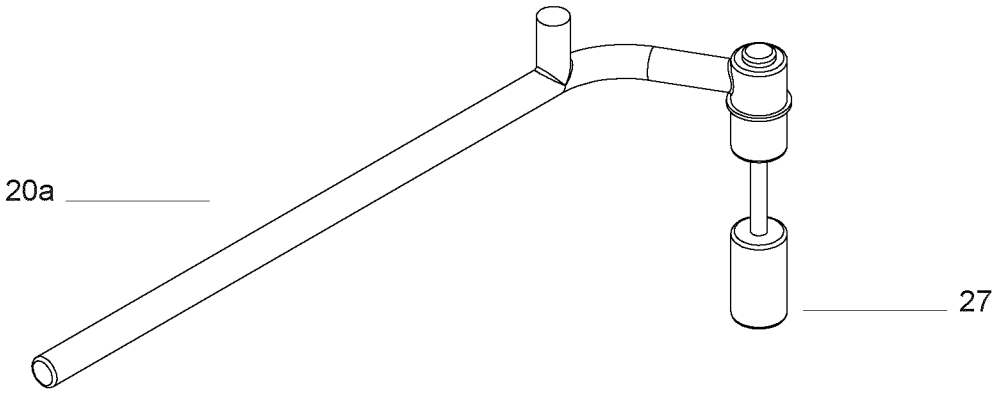
FIG. 20 is a perspective view of swivel arm support of the human systems interaction apparatus of FIG. 1.
Figure 21:
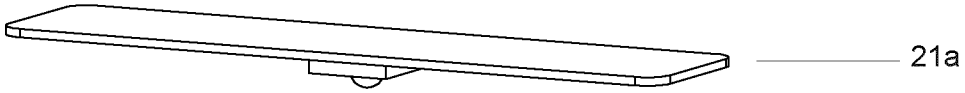
FIG. 21 is a perspective view of integrated keyboard of the human systems interaction apparatus of FIG. 1.
Figure 22:
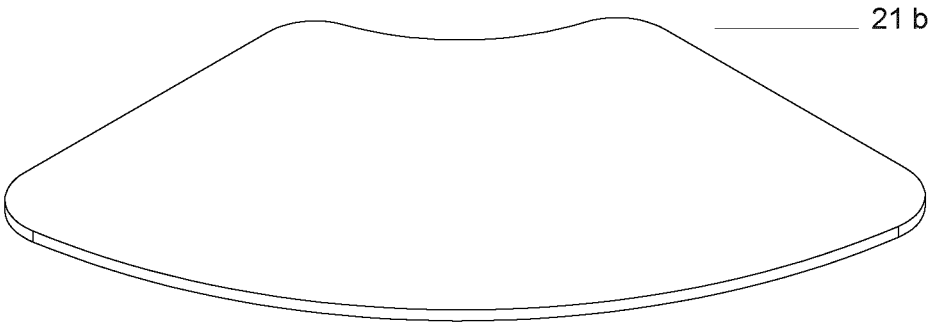
FIG. 22 is a perspective view of mouse pad of the human systems interaction apparatus of FIG. 1.
Figure 23:
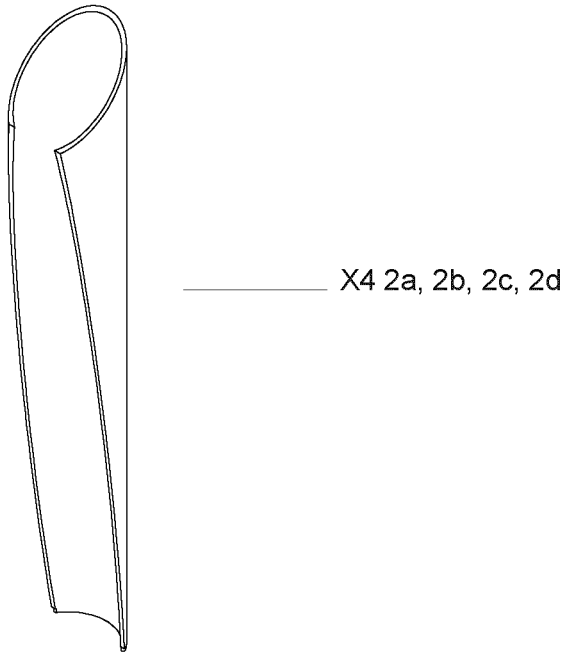
FIG. 23 is a perspective view of legs of the human systems interaction apparatus of FIG. 1.
Figure 24:
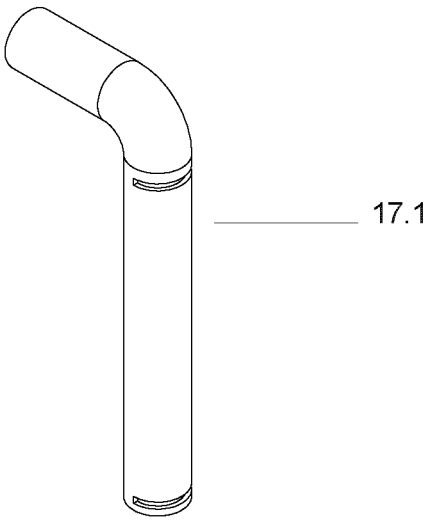
FIG. 24 is a perspective view of big and small table structural support members of the human systems interaction apparatus of FIG. 1.
Figure 25:
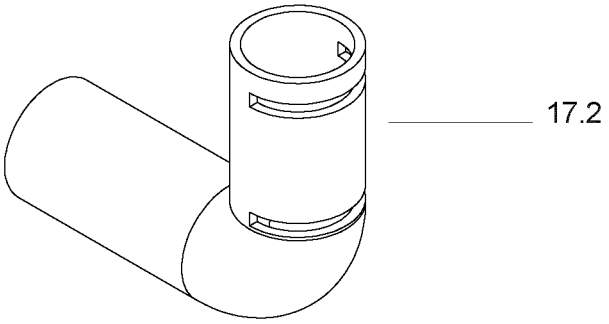
FIG. 25 is a perspective view of structural support members for coffee table assembly of the human systems interaction apparatus of FIG. 1.
Figure 26:
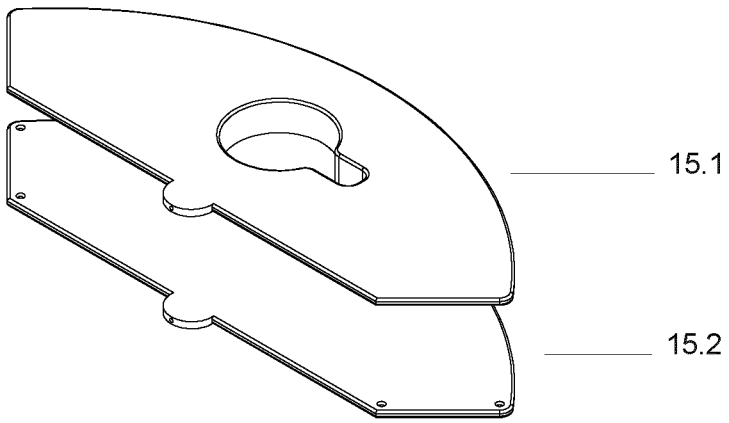
FIG. 26 is a perspective view of coffee table assembly of the human systems interaction apparatus of FIG. 1.
Figure 27:
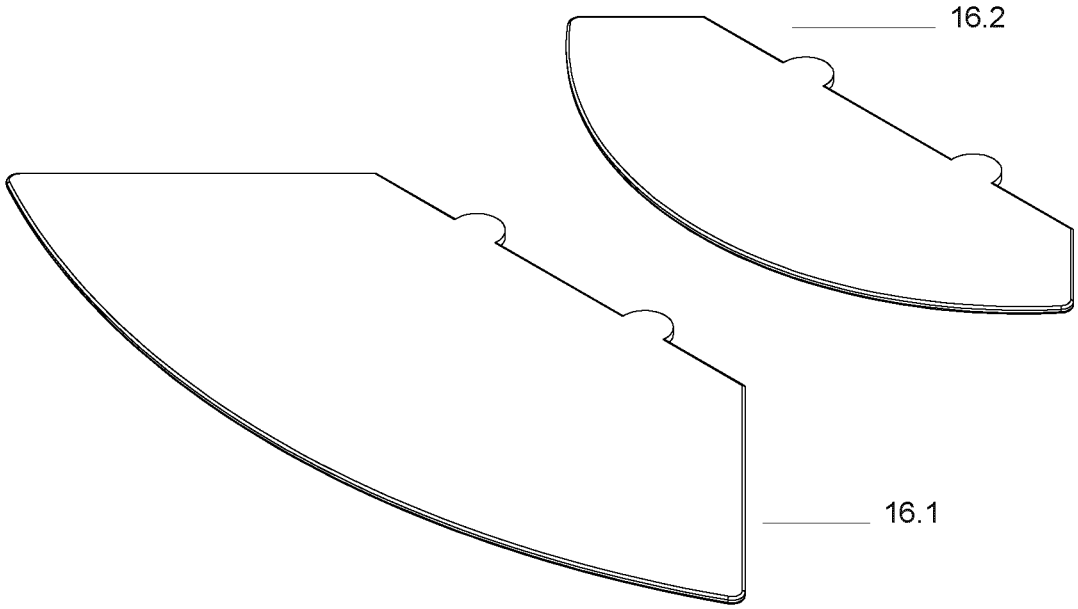
FIG. 27 is a perspective view of big- and small table of the of the human systems interaction apparatus of FIG. 1.
Figure 28:
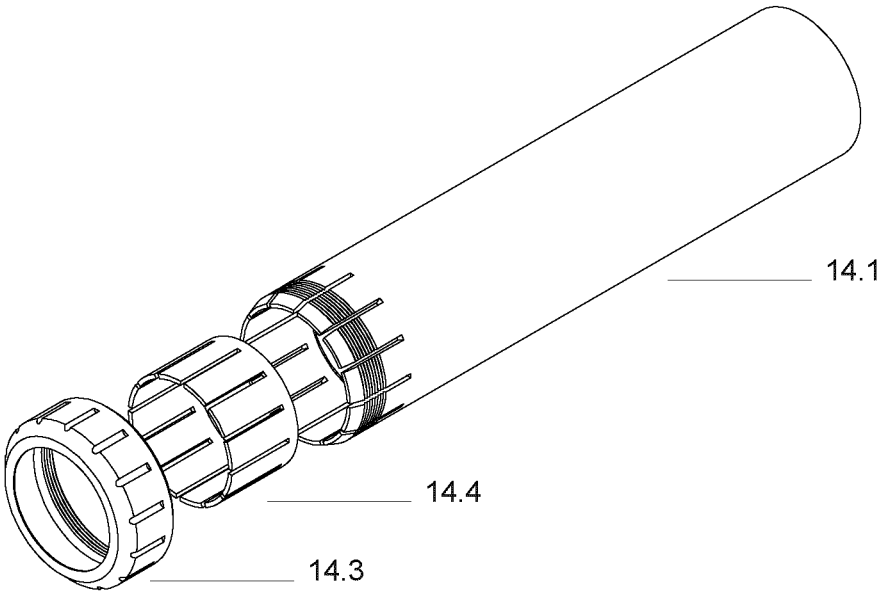
FIG. 28 is a perspective, exploded view of unassembled compression fitting, Teflon ring and nut of the human systems interaction apparatus of FIG. 1.
Figure 29:
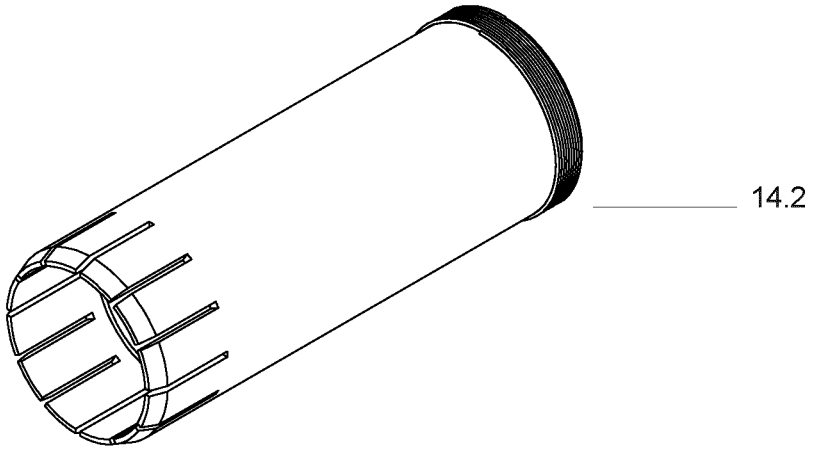
FIG. 29 is a perspective, exploded view of unassembled compression fitting 2, Teflon ring and nut of the human systems interaction apparatus of FIG. 1.
Figure 30:
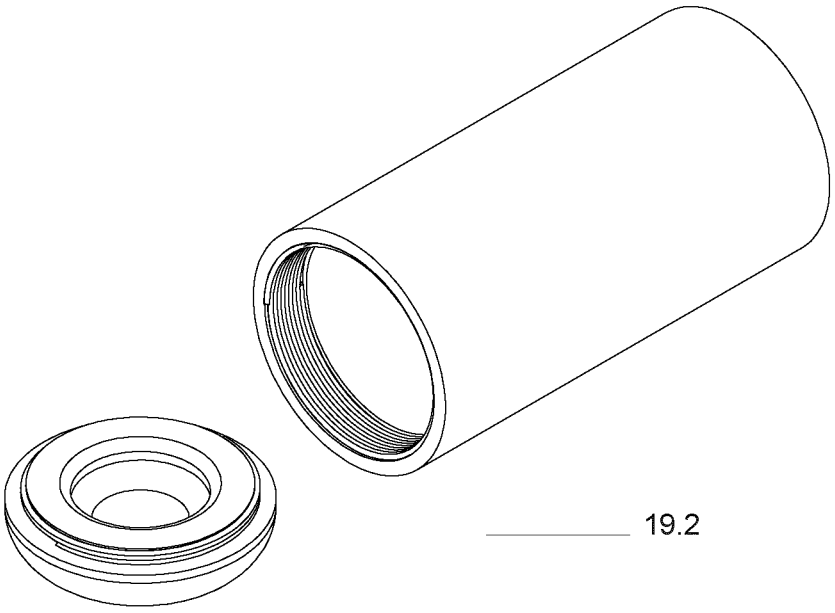
FIG. 30 is a perspective, exploded view of a universal plug and pipe of the human systems interaction apparatus of FIG. 1.
Figure 31:
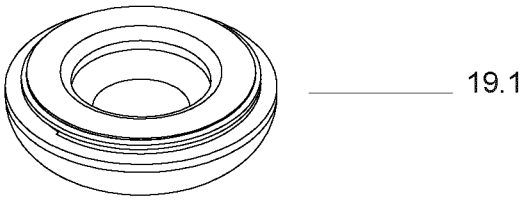
FIG. 31 is a perspective of a foot plug of the human systems interaction apparatus of FIG. 1.
Figure 32:
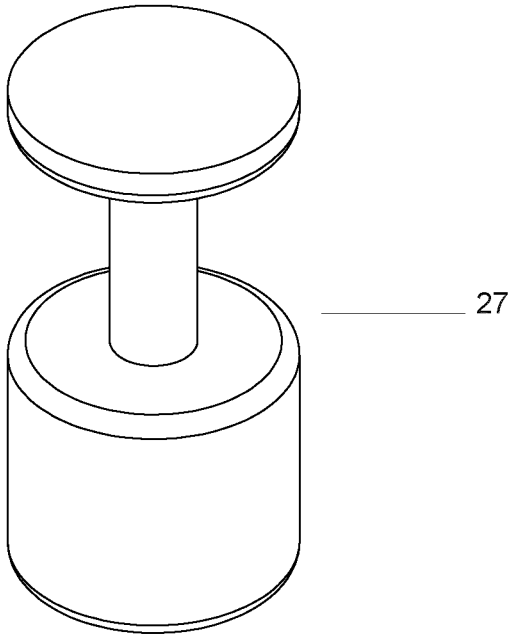
FIG. 32 is of a gas piston of the human systems interaction apparatus of FIG. 1.
Figure 33:
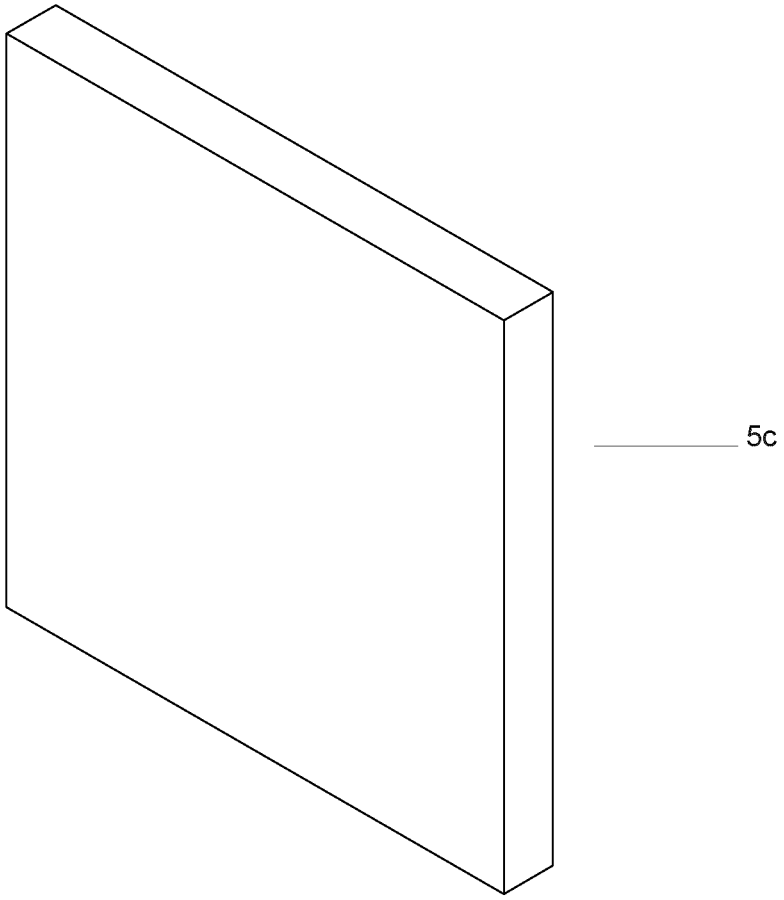
FIG. 33 is a perspective view of an insert housing an LED array of the human systems interaction apparatus of FIG. 1.
Figure 34:
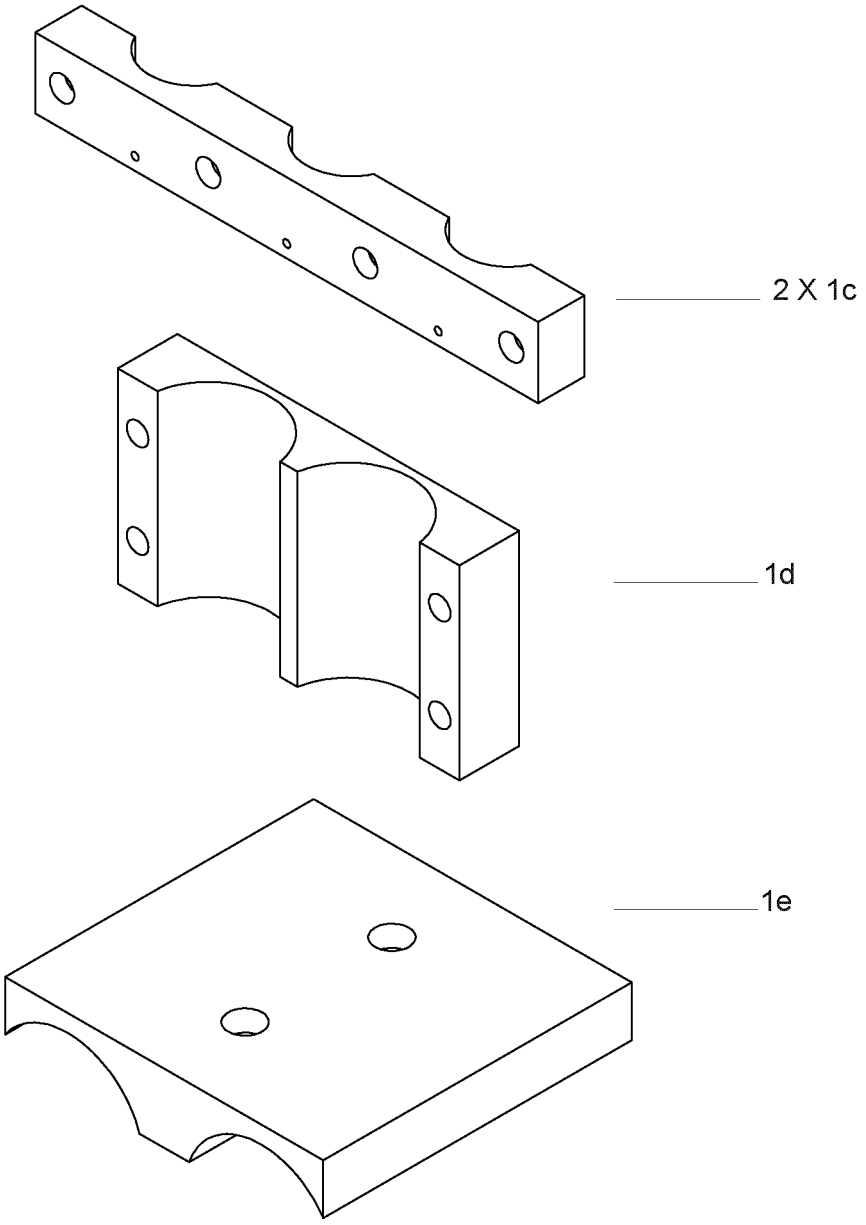
FIG. 34 is a perspective, exploded view of clamps of the primary structural support hub of the human systems interaction apparatus of FIG. 1.
Figure 35:
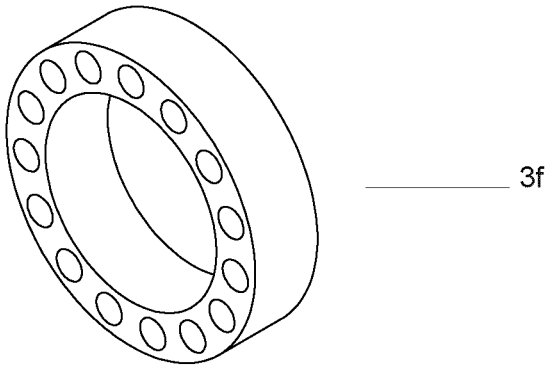
FIG. 35 is a perspective view of a bearing of the human systems interaction apparatus of FIG. 1.
Figure 36:
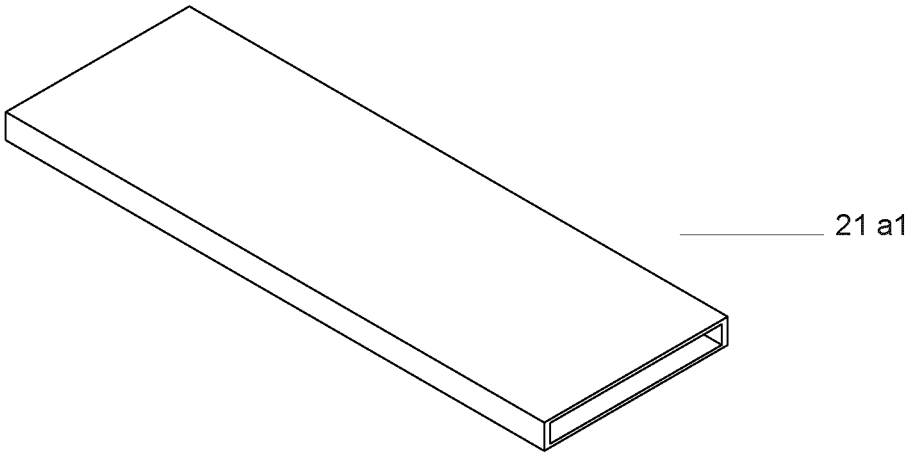
FIG. 36 is a perspective view of integrated keyboard support tray of the human systems interaction apparatus of FIG. 1.
Figure 37:
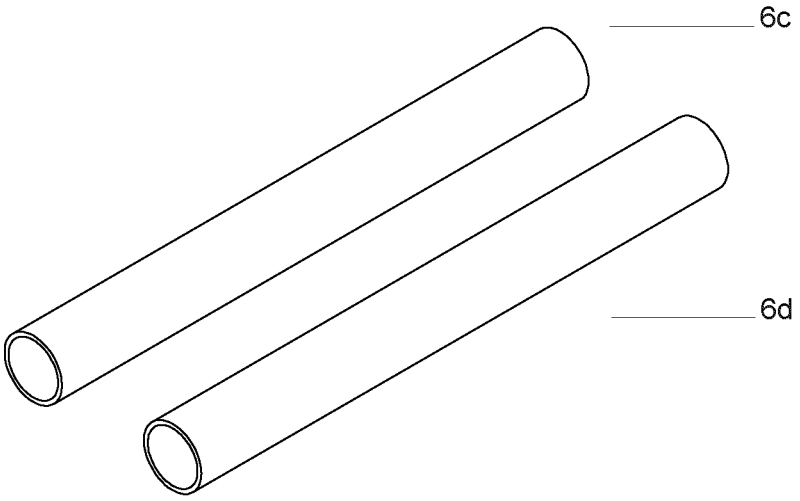
FIG. 37 is a perspective of VDT structural support frame members of the human systems interaction apparatus of FIG. 1.
Figure 38:
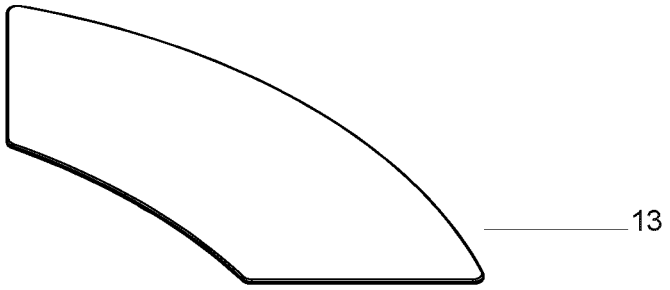
FIG. 38 is a perspective view of utility support table of the human systems interaction apparatus of FIG. 1.
Figure 39:
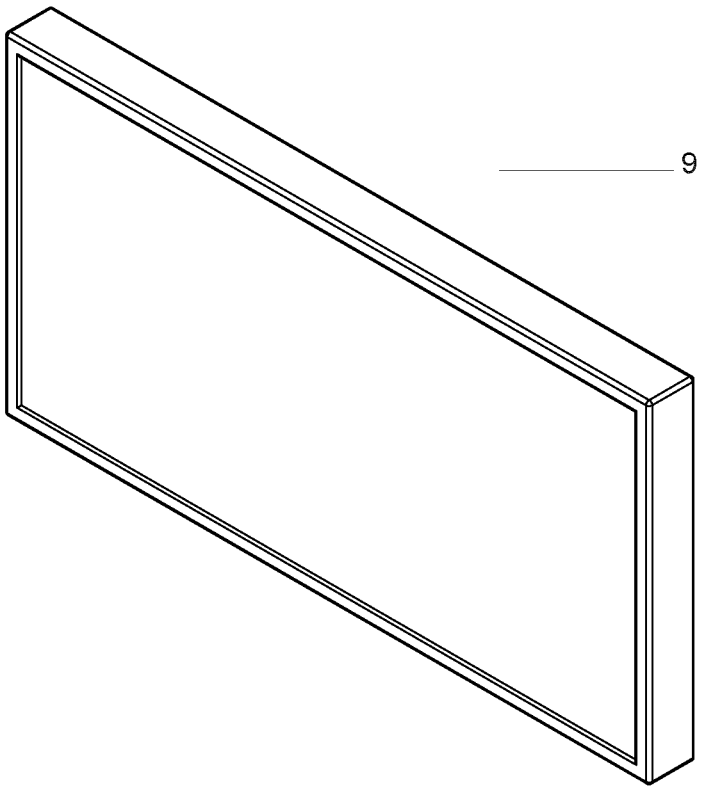
FIG. 39 is a perspective of a visual display monitor (VDT) of the human systems interaction apparatus of FIG. 1.
Figure 40:
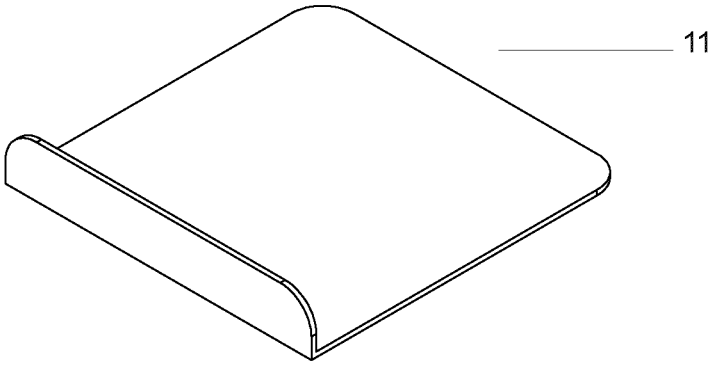
FIG. 40 is a user foot rest support of the human systems interaction apparatus of FIG. 1.
Figure 41:
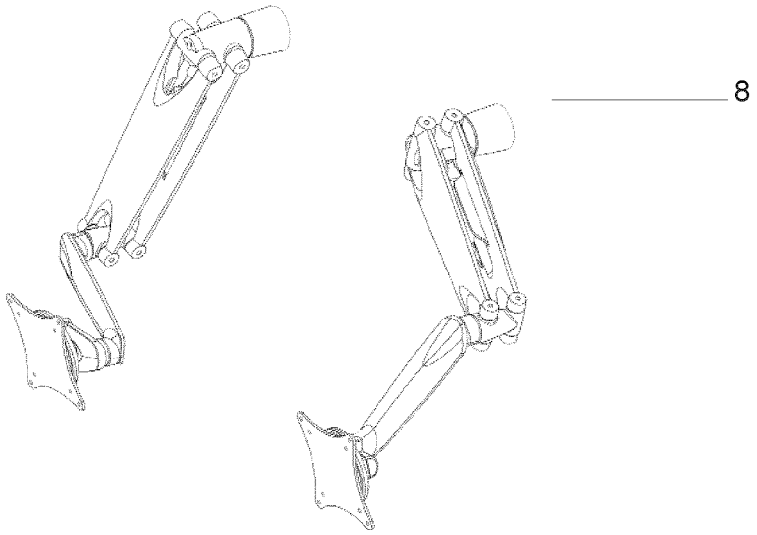
FIG. 41 is a monitor support arms of the human systems interaction apparatus of FIG. 1.

The primary structural support hub 1 is connected to a system peripheral device support which includes a keyboard support arm 20 and swivel support arm 20*a* which are best shown in FIGS. 19 and 20. Referring back to FIGS. 2A and 2B, the keyboard support arm is attached to the structural support hub at its proximal end, and may extend 425 mm, may bend 90 degrees, and may extend 425 mm. A distal end of the keyboard support arm 20 is attached the swivel support arm 20*a*. Attached to the swivel support arm 20*a* are a peripheral systems devices plate 21*a* and an integrated keyboard tray 21*a*1. A first one of the peripheral systems device plates is best shown in FIG. 21. The peripheral systems device plates 21*a* provides support to the integrated keyboard tray 21*a*1 that supports the keyboard and provides interior space for the integration of a multitude of systems devices including, but not limited to, optical readers, DVD players, re-writers, flash drives and other wired or wireless systems components. These systems components open and close at the trays distal end directly under the keyboard. As many as 8 USB external outlets may be integrated in to side of the item. The first one of the peripheral systems device plates 21*a* also allows for storage of CDs and other miscellaneous items via a sliding plate assembly under the keyboard. A mouse pad 21*b*, best shown in FIG. 22, supports a mouse, trackballs, other pointing devices, tablet writing pads, and Laptop computers. The keyboard support arm 20 can be assembled on either right or left side of apparatus. The swivel support arm 20*a* allows for the lowering and heightening of the second peripheral systems plate 21*a*, the integrate keyboard support tray 21*a*1, and the mouse pad 21*b*, via a gas piston housed internally at the distal end of the keyboard support arm 20 and allows for 360 degrees of swivel. The swivel function of swivel support arm 20*a* allows for the movement of the peripheral systems device plates 21*a* provides support to the integrated keyboard tray 21*a*1 in direct relation to the user in user area. This permits extension and retraction relative to the user in the user area.

The swivel function also allows for movement of the swivel support arm 20*a* for entry and exit of user. Furthermore, the user may freely enter and exit the user area from either side of the human systems interaction apparatus, without interfering with apparatus structure or system device peripherals attached thereto. Attached peripheral systems devices may be wireless or wired. Wires and or cables extending from the mouse, keyboard or other systems devices can be integrated within or may be wrapped along swivel support arm 20*a* or inserted into a hollow or openings in the keyboard support arm 20 to facilitate neat and tidy routing of the wires and cables. The integrated keyboard tray 21*a*1 and the mouse pad 21*b* may be a multitude of shapes and sizes and may also be used alternatively as a writing surface when paper or notepad is used by the user.

Referring back to FIG. 1A, a piston receptacle 3 affixed to the primary structural support hub 1 at a top of the primary structural support hub 1 but in other examples could also be integrated in such a way as to actually be part of the primary structural support hub 1. This allows for the insertion of a piston receptacle 3*a* into the apparatus at the proximal end. The piston receptacle 3*a* rises vertically and substantially perpendicular to the primary structural support hub 1. A distal end of the piston receptacle 3*a* allows for the connection of a chair pan mechanism 3*b*. Attached to the pan chair mechanism 3*b* is a pan chair 3*c*. Attached to the pan chair 3*c* is a lumbar support member 3*d*, a torso support member 3*e* torso support, and a head and neck support mechanism 3*f*.

There is a utility support hub 3*g* attached around the piston receptacle 3 via housing of an internal bearing. The utility support hub 3*g* has dual functions. First the entire assembled apparatus including the utility support hub 3*g*, the head and neck support mechanism 3*f*, compression fittings 14.1 and 14.2, nut 14.3, Teflon ring 14.4, Teflon insert 14.5, utility support arm 4*c*, detent hinge 18.2, and utility support table 13, together, may allow for 180 degree rotational movement of the utility support arm 4*c* and a utility support table 13. When not in use, the entire assembly retracts away from and rotates out of the users work space adopting the same profile as primary structural support members 4*a* and 4*b* directly behind the user. The utility support arm 4*c* is a shortened version of the primary structural support members 4*a* and 4*b* and may house an internal motion/locking apparatus such as a crank or piston at its distal end for the heightening and lowering of the utility support table 13. The utility support hub 3*g* houses and supports the compression fittings 14.2 and is secured at the proximal end of the compression fitting 14.2 via threads. This part of the apparatus allows for the insertion and support of the utility support arm 4*c* at its proximal end. Internally housed within the compression fitting 14.2 are the Teflon ring 14.4 and Teflon insert which together the nut 14.3 permit extension, retraction and locking of utility support arm 4*c* and utility support table 13 relative to the user in the user area. Attached to the utility support table 4*c* at its distal end is a detent hinge 18.2 which affixes to and supports utility support table 13 to utility support arm 4*c* and allows for rotational movement up to 360 degrees. This assembly combination achieves the perpendicular placement of utility support table 13 with adjustability relative to the user's body in various degrees of reclined support of user. The utility support table 13 may support USB 3.0 docking for a multitude of portable systems devices. Shown operable USB 3.0 cable runs from a hub (port) affixed on top or bellow utility support table 13 and runs through the internal volume or hollows of the utility support arm 4*c*, compression fittings 14.1 and 14.2, nut 14.3, Teflon ring 14.4, Teflon insert 14.5, the primary structural support hub halves 1*a* and 1*b* to connect internally to the primary systems hub halves 2*x* and 2*y*. The apparatus may be assembled whereas to facilitate the optimum positioning of portable peripheral systems devices used by the user in a working environment. System devices may include but are not limited to lap tops, note books, iPhones, iPads, blackberries, cell phones etc. The utility support arms 13 may be a multitude of shapes and sizes that can also be used alternatively as a writing surface when desk space is required by user.

Figure 10:
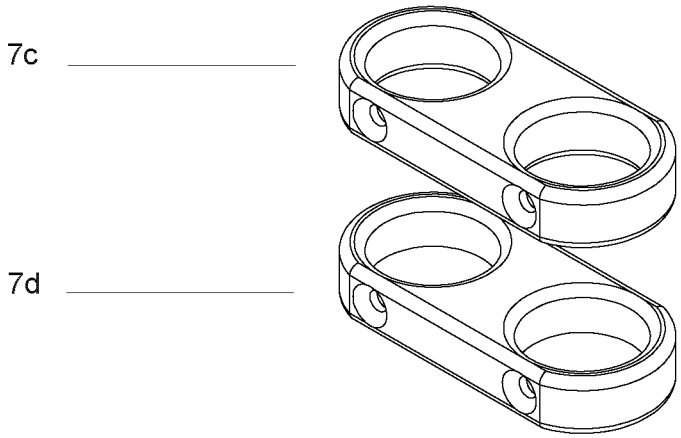
FIG. 10 is a perspective, exploded view of a micro hub structural member of the human systems interaction apparatus of FIG. 1.
Figure 11:
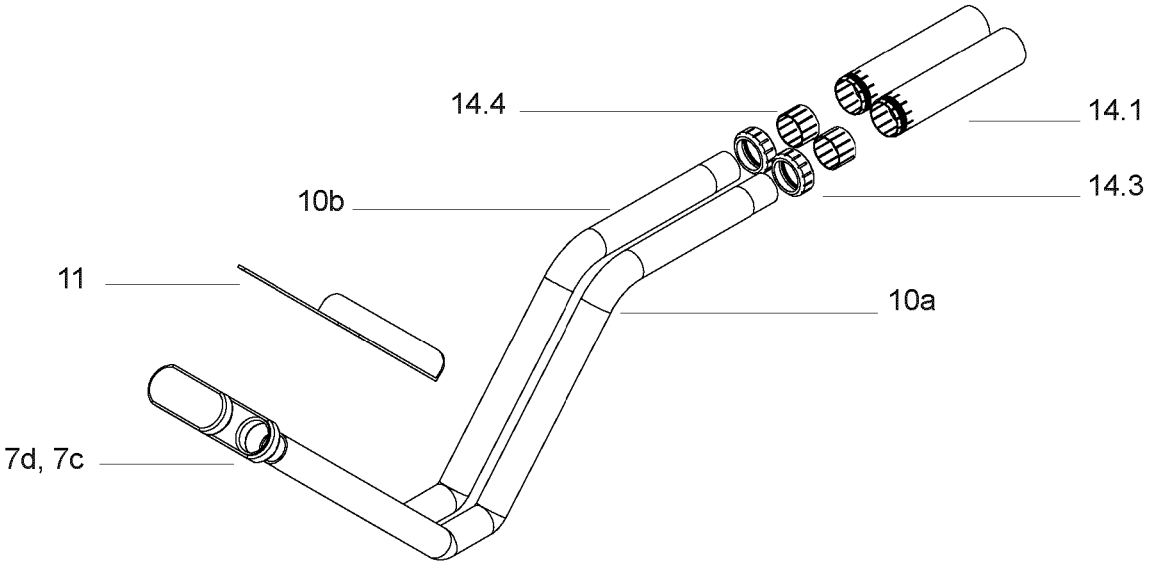
FIG. 11 is a perspective, exploded view of a micro hubs assembly of footrest members of the human systems interaction apparatus of FIG. 1.

Proximal ends of secondary structural support frame members 10*a* and 10*b* are fitted to a Teflon sleeve 14.6. The secondary structural support frame members 10*a* and 10*b* are best shown in FIG. 11. Referring back to FIG. 1A, the Teflon sleeve 14.6 allows for stabilization and ease of adjustably while traveling inside a compression fitting 14.2 on its horizontal axis. The secondary structural support frame members 10*a* and 10*b* connect to the compression fitting through the primary structural support hub 1 at a front of the primary structural support hub 1. The secondary structural support frame members 10*a* and 10*b* may extend out 283.57 mm, then may bend down 130 degrees and may continue to extend another 384.42 mm, then may bend 130 degrees and may continue to extend 73.58 mm, horizontal to the floor, then may bend again upwards another 130 degrees while possibly further extending 491 mm Micro hubs 7*c* and 7*d*, best shown in FIG. 10, which function connect a foot rest to corresponding ones of the secondary structural support frame members 10*a* and 10*b* at distal ends thereof. There is a user foot rest support 11 which is connected to a foot rest via a detent hinge directly to a flat surface of one of the micro hubs 7*c* at the distal end of Item 10 and is adjustable to fit user. The secondary structural support frame members 10*a* and 10*b* may also contain, or, have an additional support mechanism housed internally at the bottom under side portion such as a wheel for further stabilization and ease of adjustability of the secondary structural support frame members 10*a* and 10*b*. Item 10. A user calf support 12 connects to another one of the micro hubs Item 7*d* to the secondary structural support frame members 10*a* and 10*b*. This methodology may permit extension and retraction of Items 10 secondary structural support frame members 10*a* and 10*b*, the calf support 12, and the utility support arm 4*c* relative to the user in the user area.

At their proximal the secondary structural support frame members 10*a* and 10*b* are connected to the primary structural support hub 1 through Items compression fittings 14.1 and 14.2, nut 14.3, Teflon ring 14.4, Teflon insert 14.5, and Teflon sleeve 14.6 which are collectively a coupling 14 and allow for insertion of the secondary structural support frame members 10*a* and 10*b* as well as the extension and retraction of the secondary structural support frame members 10*a* and 10*b* along their substantially horizontal axis. The coupling 14 collectively operates as a double support structure of tubes being equal in length, circular, running parallel to each other, and both supporting integrated locking devices. Coupling 14 is held firmly in place to the primary structural support hub 1 by clamp 1*e* and is attached to one of the primary structural support hub halves 1*b* via threaded bolt.

Proximal ends of table structural support members 17.1 connect to the primary structural support hub 1 at sides of the primary structural support hub 1 and may extend out from the primary structural support hub 1 for 135.950 mm, running parallel may they arc downward at 90 degrees and may continue to extend 285.325 mm from centre. Each of the table structural support members 17.1 is held firmly in place and supported internally by one of the clamps 1*c* disposed with the primary structural support hub 1. Distal ends of the table supports 17.1 attached via threads in a foot plug 19.1 that may rest on the floor. The table structural support members 17.1 collectively may support a first table 16.1 and a second table 16.2 via slots cut into a front of the table structural support members 17.1. The first table 16.1 may be a large table and a second table 16.2 may be small table. The tables 16.1 and 16.2 are both shaped in such a way as to conform to the downward expansion of the pyramidal support structure and are affixed in place by screws threaded through the back of the table structural support members 17.1 The first table 16.1 has threaded recessed holes on its front bottom portion for the insertion via threads of the foot plugs 19.1 and may allow the first table 16.1 to rest on the floor. The first table 16.1 is approximately 772.943 wide, 200.852 in depth and ¼ inch thick and may support a multitude of peripheral systems devices. The second table 16.2 sits above the first table in this example. The second table is 16.2 is approximately 562.674 mm in length and 200.852 in depth and is congruent in shape and material with the rest of the adjoining support tables.

The proximal end of a table structural support members for a drinking/double table 17.2 attach to the primary structural support hub on the opposite configured side of table structural support members 17.1 and are held firmly in place by one of the clamps disposed in the primary structural support hub 1*c*. The table structural support members for a drinking/double table 17.2 may extend outward from the primary structural support hub for a distance of 108 mm and may arc downward at 90 degrees extending 133.400 mm. The table structural support members for a drinking/double table 17.2 may support a small table for drinking or a drinking table 15.1 and a coffee table 15.22. The drinking table 15.1 and the coffee table 15.2 are affixed to the table structural support members for a drinking/double table 17.2 in the same fashion as the first table 16.1 and the second table 16.2 are joined to table structural support members 17.1. Additionally, the drinking table

15.1 and the coffee table 15.2 are also joined and held together by post assemblies 15.3. The posts assemblies 15.3 are hollow aluminum tubes approximately 2 inches in length, ¼ inch in thickness and are fastened from the bottom of coffee table 15.2 and connect through to the bottom of the drinking table 15.1 via screws. Paired in this fashion they provide functional support for hot and cold liquid beverages. Attached via threads at the distal end of the table structural support members for a drinking/double table 17.2 is the foot plug 19.1. It is the intent of this support to position beverages out of the way in the users work space at the same time maintaining a functioning operational distance in relation to the user while in a relaxed ergonomic position.

Figure 9:
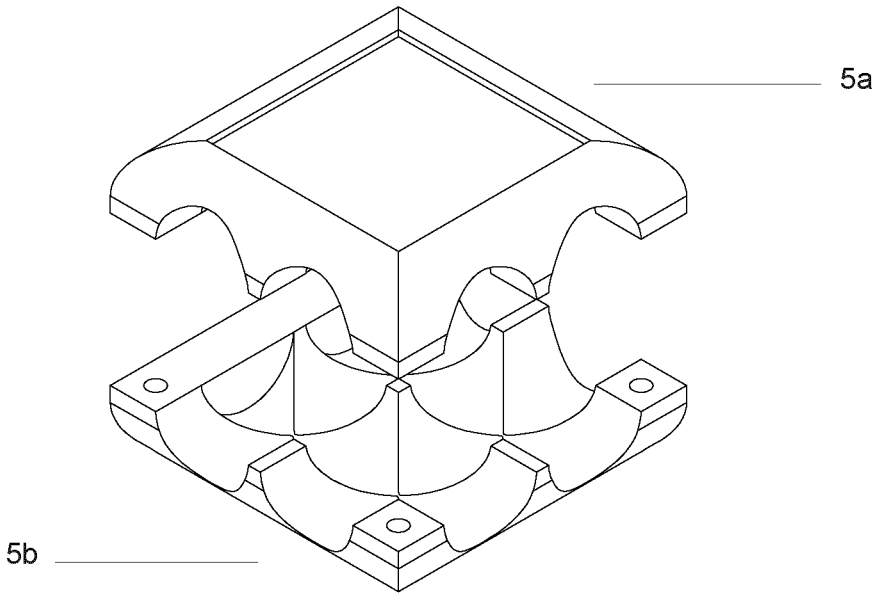
FIG. 9 is a perspective, exploded view of a macro hub structural member of the human systems interaction apparatus of FIG. 1.

The proximal ends of anterior primary structural supports 4*a* and 4*b* connect to the primary structural support hub 1 at a rear of the primary structural support hub 1 and are held firmly in place by one of the clamps 1*d* disposed with the primary structural support hub 1. The clamp 1*d* attaches to one of the primary structural support hubs 1*b* via a threaded bolt. The anterior primary structural supports 4*a* and 4*b* may extend outward from the primary structural support hub 1 for 188.52 mm and may arc upward at 125 degrees and may continue to extend 622.06 mm parallel to a lumbar support 3*d*, head and neck support 3*e*, and torso support 3*f*. The anterior primary structural supports 4*a* and 4*b* then may bend 35 degrees and may extend another 580.33 mm perpendicular to the chair pan 3*c*. Macro hubs 5*a* and 5*b*, best shown in FIG. 9, connect at the distal end of Item 4 the anterior primary structural supports 4*a* and 4*b* and parallel to the torso support 3*f*. The anterior primary structural supports 4*a* and 4*b* may be in the shape of a double tube structure with both tubes being equal in length, circular and running parallel to each other. The internal volume or hollows of the anterior primary structural supports 4*a* and 4*b* and the macro hubs 5*a* and 5*b* allow for the systems cable management and integration of aforementioned power and data cables. A further macro hub Item 5*c* inserts in to macro hub 5*b* and may house any number of LED lights to be fitted in such away so as to light from behind the company logo that is etched in to the macro hub 5*c*. Company logo may also be fitted in such a way as to be used as a switch, or, to house switches to turn on/off any number of items integrated in to the system.

Figure 12:
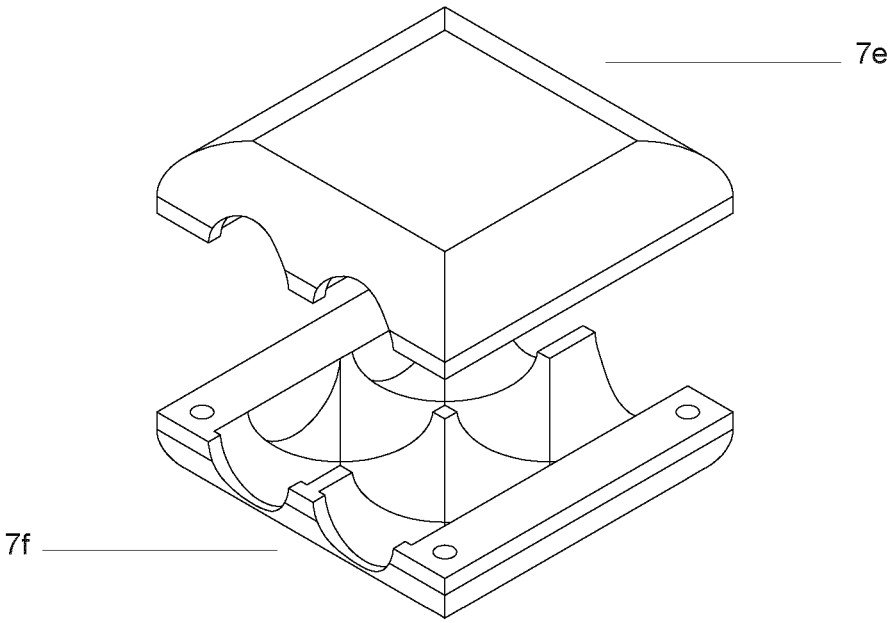
FIG. 12 is a perspective, exploded view of a micro hubs assembly of single monitor support members of the human systems interaction apparatus of FIG. 1.
Figure 13:
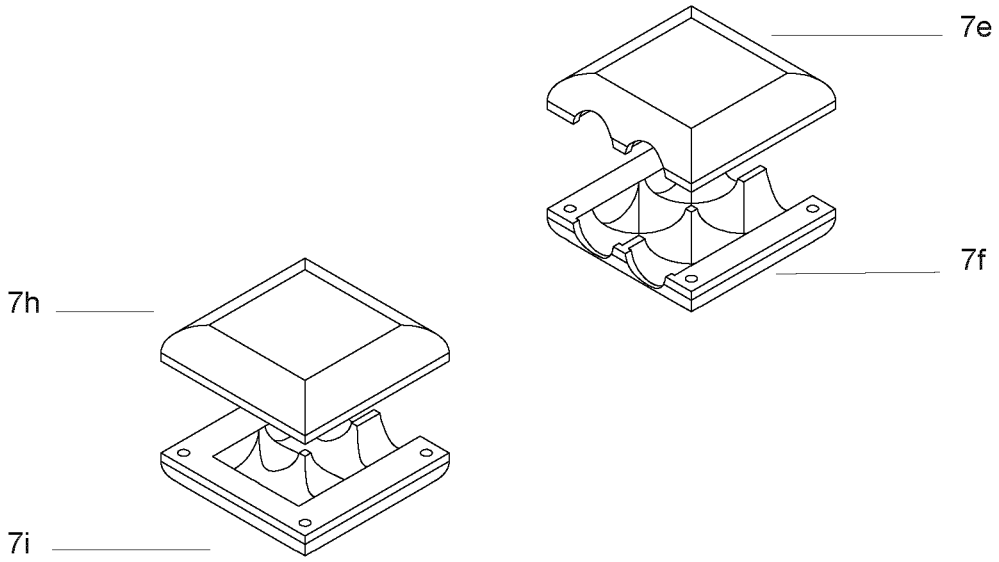
FIG. 13 is a perspective, exploded view of micro hubs assembly of dual monitor support members of the human systems interaction apparatus of FIG. 1.
Figure 14:
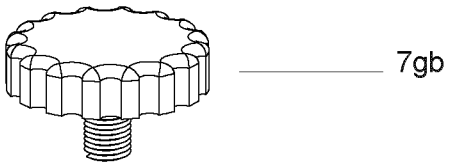
FIG. 14 is a perspective view of a dual monitor support/mount lock of the human systems interaction apparatus of FIG. 1.
Figure 15:
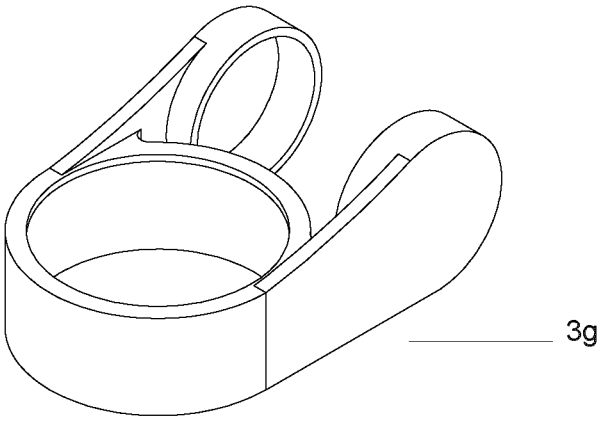
FIG. 15 is a perspective view of utility support hub of the human systems interaction apparatus of FIG. 1.
Figure 16:
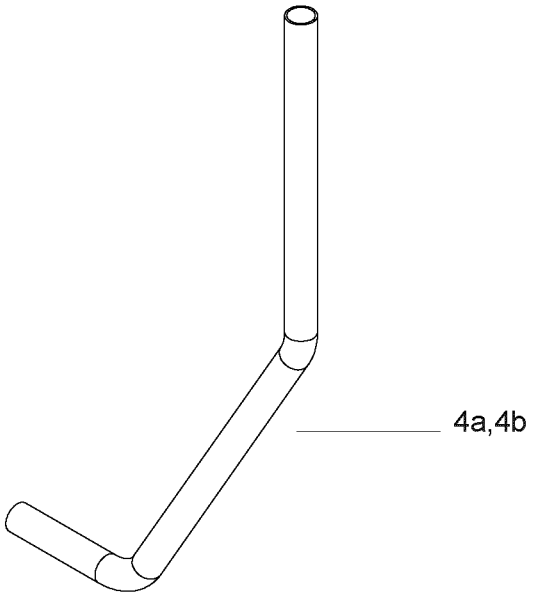
FIG. 16 is a perspective view of primary structural support structure members of the human systems interaction apparatus of FIG. 1.
Figure 17:
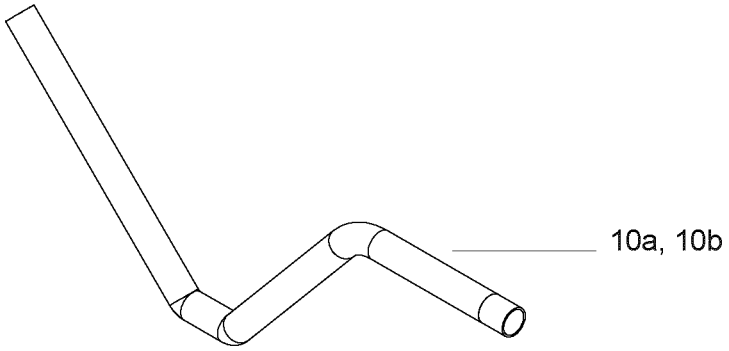
FIG. 17 is a perspective view of secondary structural support structure members of the human systems interaction apparatus of FIG. 1.
Figure 18:
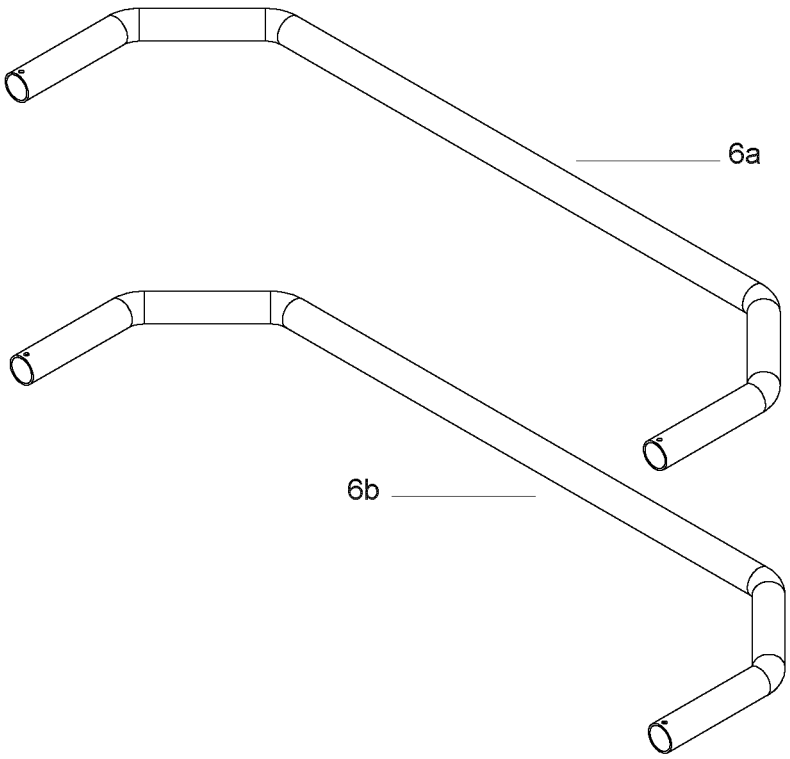
FIG. 18 is a perspective view of visual display terminal (VDT) support structure members of the human systems interaction apparatus of FIG. 1.

The proximal ends of primary VDT structural support frame members 6*a* and 6*b* connect to the macro hubs 5 at either side, and may extend 209.29 mm parallel to a bearing 3*f*, then may bend 135 degrees and may extend 188.58 mm, then may bend 135 degrees. VDT structural support frame members 6*a* and 6*b* may further extend 983.31 mm at a perpendicular angle to the bearing 3*f*, then may bend 135 degrees, and may extend 188.58 mm, then may bend 135 degrees, and may extend 209.29 mm parallel to the bearing 3*f* at a distance of approximately 1250.00 mm, and an approximate distance of 1100.00 mm from the user eyes. At the distal ends of the structural support frame members 6*a* and 6*b* connect to micro hubs 7*e* and 7*f* which are best shown in FIGS. 12 and 13. A monitor mounting plate 7*j* attaches to the micro hubs 7*e* and 7*f* back and front via M4 screws and support a monitor support arm. The VDT monitor 9 is affixed thereto. The assembly of the primary VDT structural support frame members 6*a* and 6*b*, micro hubs 7*e* and 7*f*, and a monitor support arm 8 results in the adjustability of the VDT monitor 9 on the X, Y, and Z axis, and allows for VDT monitor 9 to tilt relative to the user's eyes facilitating use without leaning or bending the neck, or, the head of the user. This methodology may permit the proper positioning of VDT monitor in direct relation to the user's eyes. This method may facilitate ISO 9241 standards use of VDT monitor 9 by user.

Multiple alternative assemblies of maybe used to support multiple VDT monitors 9 along the entire distance (2179.05 mm—in this example) of the primary structural support frame members 6*a* and 6*b*. A first secondary monitor mount 7*i* and a second secondary monitor mount 7*h* may act together as one support device for additional multiple monitor placements in to the users environment and are fastened back and front by bolts. This assembly combination allows for the secondary VDT structural support frame members 6*c* and 6*d* to be inserted and secured at their distal ends by the first secondary monitor mount 7*i* and the second secondary monitor mount 7*h*. After assembly the secondary VDT structural support frame members 6*c* and 6*d* are to be inserted first through a monitor support lock 7*g*A and in to the distal ends of the primary structural support frame members 6*a* and 6*b* so as to move along their horizontal axis extending in and out of the primary VDT structural support frame members 6*a* and 6*b*. A monitor support lock 7*g*B locks the secondary VDT structural support frame members 6*c* and 6*d* in place when the required distance for monitor placement is achieved by the user. This assembly combination can be used with the extenuation for viewing multiple VDT monitor 9 displays by a single user while achieving perpendicular placement, and adjustability thereto, relative to the user's eyes in various degrees of reclined support of user. The internal volume of the primary and secondary VDT structural support frame members 6*a*, 6*b*, 6*c* and 6*d* allows for the systems cable management and integration of aforementioned power and data cables. The micro hubs 7*a* and 7*b* are to be placed along primary VDT structural support frame members 6*a* and 6*b* for torque resistance where additional structural support is needed due to multiple monitor integration.

The user may be received in the area forward and parallel of the primary and secondary VDT structural support frame members 6*a*, 6*b*, 6*c* and 6*d* and supported by chair pan mechanism 3*b*, chair pan 3*c*, lumbar support 3*d*, head and neck support 3*e*, and bearing 3*f*. The user area is generally at 1000 mm along X-axis (+,−), 1000 mm along Y-axis (+,−), 1000 mm along Z-axis (+,−) relative to front of the upper torso of the user. In other examples, other dimensions may be provided.

The peripherals systems devices may be supported relative to the user area, and have adjustability along Y-axis, X-axis and Z-axis, and tilt function. This method may facilitate ISO 9241 standards use of peripheral systems devices by user. All system devices and peripheral devices are supported; therefore, do not detract from available flat space in apparatus. The peripheral systems devices may be supported to provide for minimal space usage immediately surrounding the user. This method may make the apparatus minimal in terms of overall physical space, and relatively approximate in size in direct comparison to the size of the user. This renders the apparatus compact and space saving. In this example, the overall length of the apparatus 1300 mm and width is 990 mm. The apparatus supports users weighing >200 kg, positioned approximately at a centre of gravity of the apparatus. The apparatus may support a total weight of >500 kg.

In an alternative configuration the primary structural support frame members 4*a* and 4*b*, the secondary structural support frame member 10*a* and 10*b*, and the primary and secondary VDT structural support fame members 6*a*, 6*b*, 6*c* and 6*d*, are tubular portions are made from straight pieces of carbon fibber pipe, the curved, or bended portions are realized through the insertion of corresponding Items 26. Elbows is seen as an alternative when, and if, the carbon fibber structural members cannot receive bends.

Figure 1B:
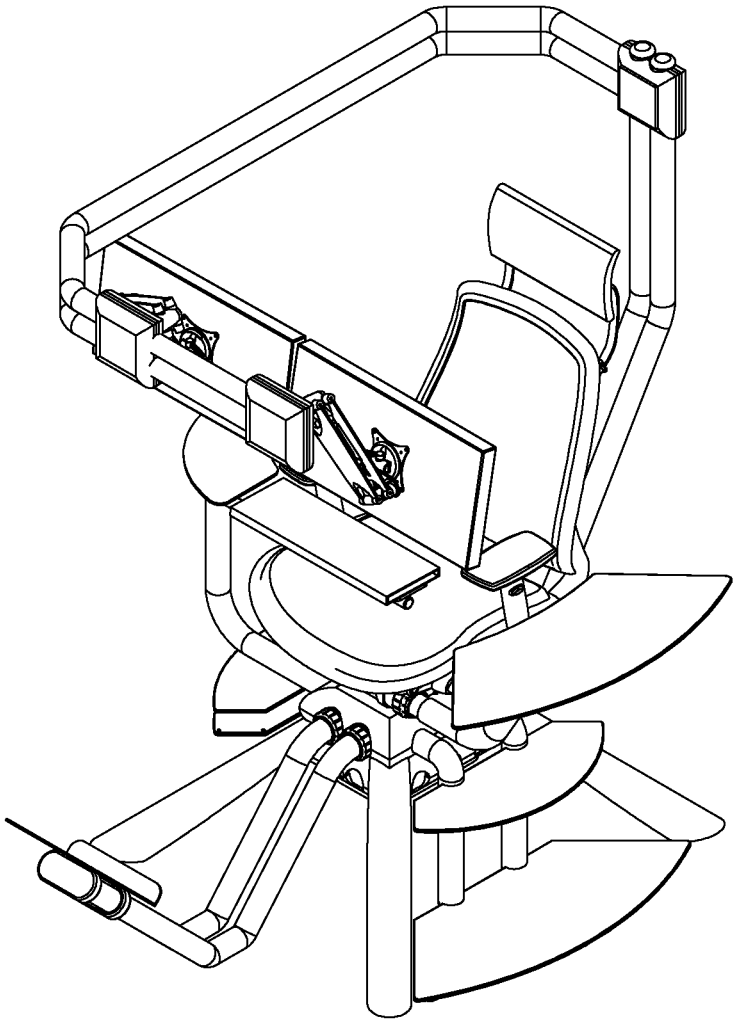
FIG. 1B is a perspective view of an improved human systems interaction apparatus.
Figure 2A:
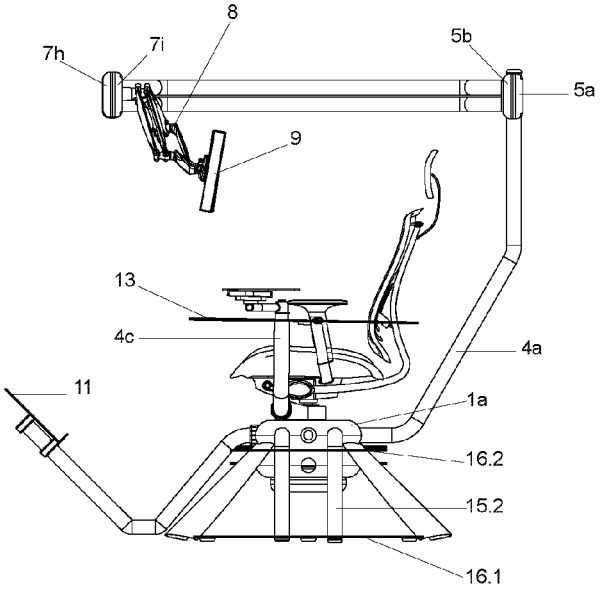
FIGS. 2A and 2B are side elevation views of the human systems interaction apparatus of FIG. 1.
Figure 2B:
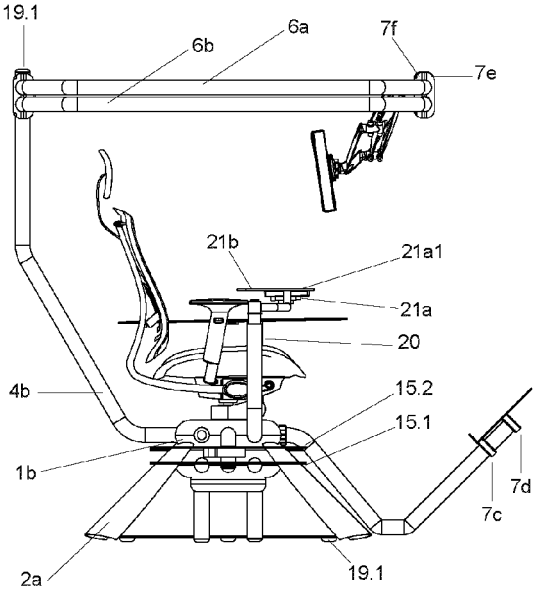
Figure 3:
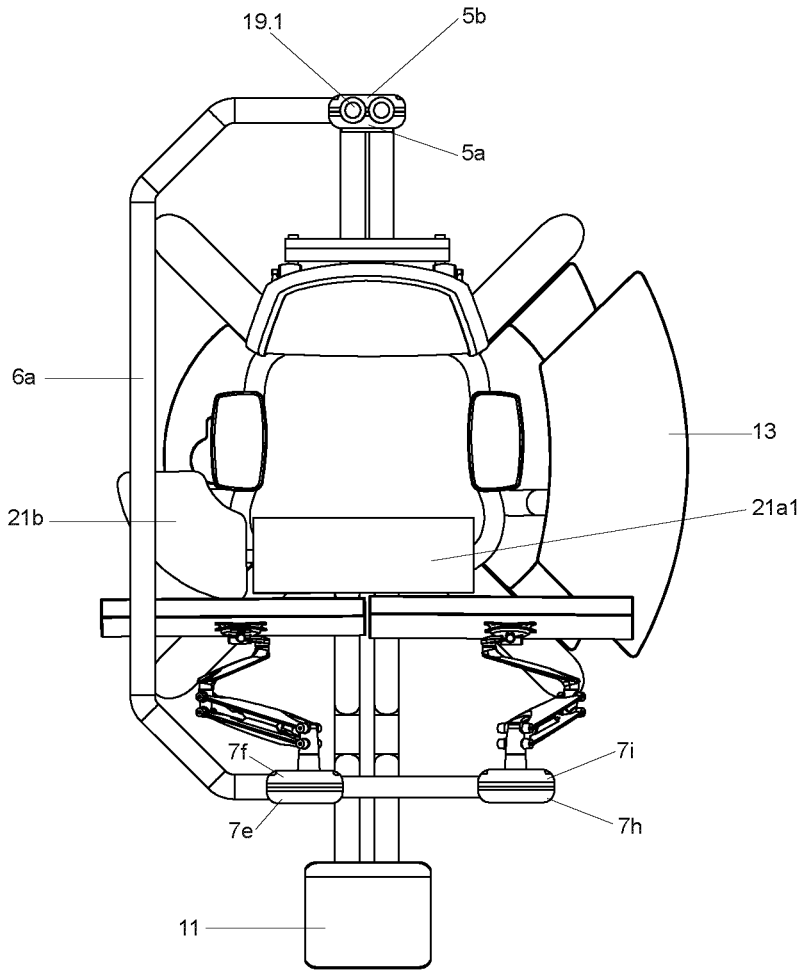
FIG. 3 is a top plan view of the human systems interaction apparatus of FIG. 1.
Figure 4:
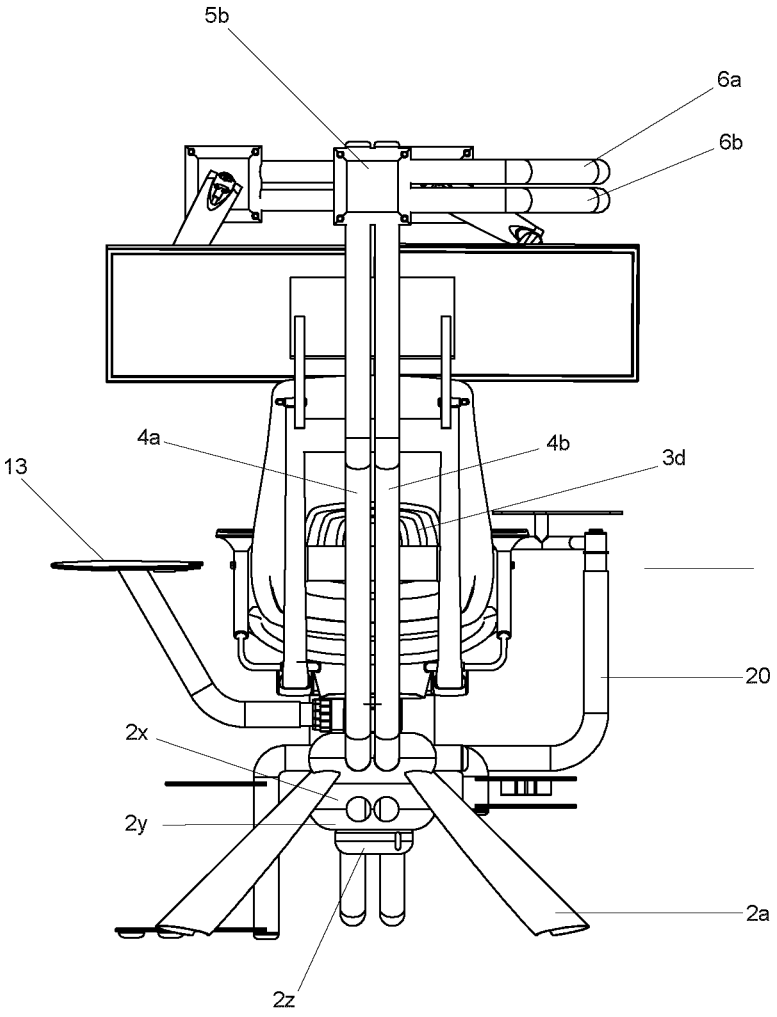
FIG. 4 is a rear elevation view of the of the human systems interaction apparatus of FIG. 1.
Figure 5:
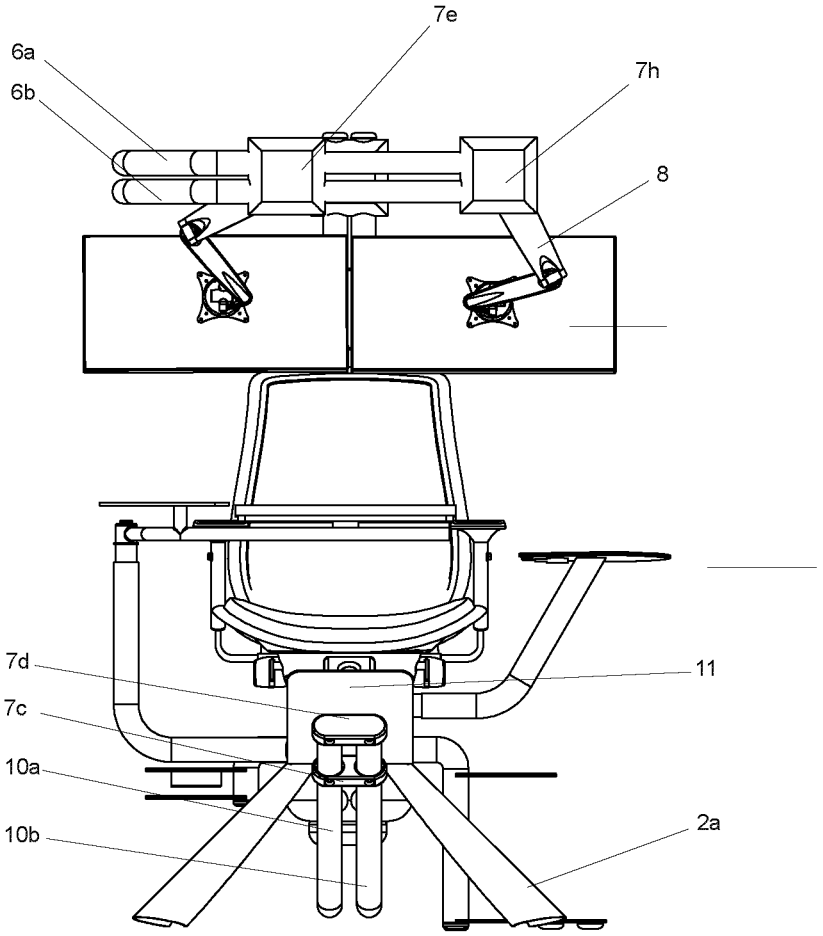
FIG. 5 is a front elevation view of the human systems interaction apparatus of FIG. 1.
Figure 6:
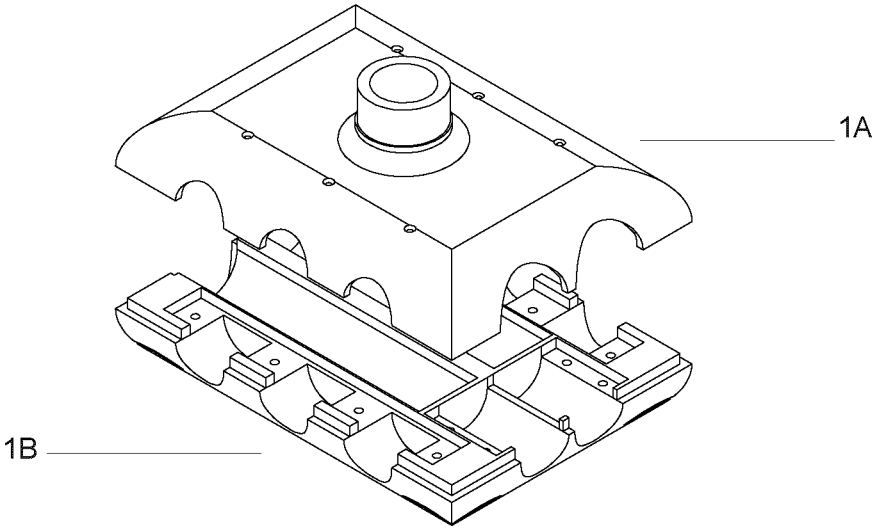
FIG. 6 is a perspective, exploded view of a primary structural support hub of the human systems interaction apparatus of FIG. 1.

A second embodiment of the human system interaction retains all the structural components and operational functions as seen in FIGS. 1A and 1B, but differs in such that a structural support dampener 24 extends vertically up from the distal end of the keyboard support arm 20 to connect to the underside of the VDT monitor support frame members 6*a* and 6*b*. The structural support dampener 24 can be attached at its proximal end to the keyboard support arm 20 by micro hubs, clamps, bolts, screws, or, configured in such a way that permits an insert (male) to be joined in to the top (female) portion of the swivel support arm 20*a*. The structural support dampener 24 attaches at its distal end to the VDT monitor support frame members 6*a* and 6*b* way of bolts, screws, micro hubs, or, have its distal end fashioned in such that it takes on the profile of the VDT monitor support frame members 6*a* and 6*b* allowing the VDT monitor support frame members 6*a* and 6*b* to sit half inside the top of Item 24. This configuration accomplishes vibration dampening of the VDT monitor support frame members 6*a* and 6*b* and lends to the overall structural integrity of the apparatus when additional, and or, larger monitors are integrated into the apparatus.

A third embodiment of the human system interaction apparatus includes the same the primary structural support halves 1*a* and 1*b* and the legs 2*a*, 2*b*, 2*c*, 2*d*. However, keyboard support arm 20 has been modified slightly to receive an additional component, a gas piston monitor support mount that is supported in such a way as to sit atop the swivel support arm 20*a*, or to be received through the swivel support arm 20*a* and be attached to the internal mechanics of the keyboard support arm 20. The keyboard support arm 20 houses an internal gas piston that facilitates the vertical positioning as well as the rotational motion for the swivel support arm 20*a*, the peripheral systems device plate, the integrated keyboard tray, and the gas piston monitor support arm 23. The gas piston support arm has articulated movement along the X, Y, Z axis and allowing for the VDT monitor tilt relative to the users eyes, facilitates the user without any leaning, or bending, of the head and neck. With the addition of gas piston monitor support arm 23 that the overall size and appearance of the apparatus may be greatly reduced while at the same time not detracting in any way from the fundamental ideology or the structural integrity of the apparatus. The apparatus retains all of the scalability to its lower and upper portions but is shown to be as minimalistic as possible while achieving ergonomic and biomechanical positioning of the human, systems, and peripheral support apparatus.

A fourth embodiment of the human system interaction apparatus has primary VDT monitor structural support frame members 6*a* and 6*b* moved to the opposite side. The foot rest may be received on the entire portions of the primary structural support frame members 4*a* and 4*b* and the VDT monitor structural support frame members 6*a* and 6*b*. An additional version of the keyboard support arm 20 is added to the opposite side of primary systems hub 2 to facilitate holding transversely extending peripheral support members to which system devices plates 21*a*, 21*a*1 and 21*b* may be attached to hold various other peripheral devices such as printers, speakers, or a table top. In this embodiment the table top is shaped to follow the contour of the rearward portion of the user area. In this embodiment more area is used by the apparatus due to the scalability of peripheral system devices. The apparatus is may be assembled whereas the optimum position along x-axis, y-axis, and z-axis for peripheral systems devices used by user is achieved. This method may facilitate ISO 9241 standards use of peripheral systems devices.

A fifth embodiment of the human system interaction apparatus includes the same primary VDT structural support frame members 6*a* and 6*b* but differs in such that it includes the use of the dual portions of the secondary monitor mounts 7*h* and 7*i* together with secondary VDT structural support frame members 6*c* and 6*d*. The secondary VDT structural support frame members 6*c* and Item 6*d* may be facilitated by securing the first and second relatively short tubular sections through a first one of the secondary monitor mounts 7*h* and in to the end or rear portion of a second one of the secondary monitor mounts 7*i*. Both of the secondary monitor mounts 7*h* and 7*i* may have respective end portions of reduced diameter that are operable to receive the secondary VDT structural support frame members 6*c* and 6*d*. The first and second short tubular sections are operable to be received into the axial openings of a monitor support lock 7*g*A permitting the retraction in and out of primary VDT structural support frame members 6*a* and 6*b* respectively. In its entirety, the assembled apparatus supplies the structural support for integration and ease of positioning for up to two additional monitors. This embodiment of the human system interaction apparatus may be further provided with an additional Items 7 along the entire length of Item 6*a*, 6*b* as to add righty and reduce torque for the VDT structural support frame members 6*a*, 6*b*, 6*c* and 6*d*.

A sixth embodiment of the human system interaction includes additional secondary additional VDT structural support frame members shown operable to be connected to an additional micro hub the additional secondary additional VDT structural support frame members, and an additional secondary additional VDT structural support frame members together to permit for additional peripheral systems devices placement and support. Micro hubs in combination with multiple macro hubs can be placed along entire length of either portion of additional secondary additional VDT structural support frame members as to provide scalability for multiple peripheral systems devices placement and support. In the embodiment shown, the support of Macro hub 1 shown generally at the rear of the human system interaction apparatus, is now also positioned in front of the user where other devices for suspending may alternatively be employed. A first articulate monitor support arm 8 may be secured directly to the surface of a micro hub or a micro hub. Bolts or clamps may be used to secure the monitor support arm 8 against movement and to further facilitate the securing of monitor support arm 8 to the micro hubs or any combination of macro hubs 7*e* and 7*j*. The monitor support arm 8 and VDT monitor 9 can be positioned in various strategic positions along either portions of of additional secondary additional VDT structural support frame members for desired viewing by user in user area.

A third embodiment of the human system interaction apparatus includes the same the primary structural support halves 1*a* and 1*b* and the legs 2*a*, 2*b*, 2*c*, 2*d*. However, it further includes a but differs from the embodiment shown in Image Y in that it includes a step 22 operable to receive respective ends of the legs 2*a*, 2*b*, 2*c* and are fitted at the corresponding top corners of the front and rear portions of the step 22. The step 22 permits the user to enter and exit the apparatus by stepping up in to the system, and down, out of the system. By raising the entire apparatus it places the monitors above most of the user population heads minimizing the effect while entering in to an environment where multiple monitors are present step 22 can be 8 to 10 inches in height and 8 to 10 inches deep and made from any number of materials including but not exclusive to plastic, poly carbonate resins, carbon fibber, aluminum, glass, acrylics, or any combination thereof.

An eighth embodiment of the apparatus retains all the structural components and operational functions as seen in FIGS. 1A and 1B, but differs in that such that the structural support vibratory dampener 24 extends vertically up from the distal end of the swivel arm support 20 to connect to the underside of the primary VDT structural support frame members 6*a* and 6*b*. The structural support vibratory dampener 24 can be attached at its proximal end to the keyboard support arm 20 by micro hubs, clamps, bolts, screws, or, configured in such a way that permits an insert (male) to be joined in to the top (female) portion of swivel arm support 20*a*. The structural support vibratory dampener 24 attaches at its distal end to primary VDT structural support frame members 6*a* and 6*b* by way of bolts, screws, micro hubs, or, have its distal end fashioned in such that it takes on the profile of primary VDT structural support frame members 6*a* and 6*b* allowing primary VDT structural support frame members 6*a* and 6*b* to sit half inside the top of the structural support vibratory dampener 24. This configuration accomplishes vibration dampening of the primary VDT structural support frame members 6*a* and 6*b* and lends to the overall structural integrity of said apparatus when additional, and or, larger monitors are integrated into said apparatus. The structural support vibratory dampener 24. may also be used in reference to an alternative configuration of the eighth embodiment to support the secondary VDT structural support frame members 6*a* and 6*b*

A ninth embodiment of the human system interaction apparatus includes the same the primary structural support halves 1*a* and 1*b* and the legs 2*a*, 2*b*, 2*c*, 2*d*. However, keyboard support arm 20 has been modified slightly to receive an additional component, a gas piston monitor support mount that is supported in such a way as to sit atop the swivel support arm 20*a*, or to be received through the swivel support arm 20*a* and be attached to the internal mechanics of the keyboard support arm 20. The keyboard support arm 20 houses an internal gas piston that facilitates the vertical positioning as well as the rotational motion for the swivel support arm 20*a*, the peripheral systems device plate, the integrated keyboard tray, and the gas piston monitor support arm 23. Shown operable gas piston monitor support arm 23 demonstrates articulated pivots at three structural connection points, and allows for the VDT monitors 9 to tilt relative to the user's eyes, facilitates the user without any leaning, or bending, of the head and neck. The swivel support arm 20*a* also provides the structural integrity, and is shown to support the utility support table 13 thereby replacing the peripheral systems devices plates 21*a* and mouse pad 21*b*, and eliminating the utility support hub 3*g*, utility support arm 4*c*, compression fitting 14.2, and detent hinge 18.2. In this embodiment the utility support table 13 is modified to receive the integrated keyboard tray 21*a*1 at the underside of said tab the utility support table 13, and attaches by a mechanism in such a way that the integrated keyboard tray 21*a*1 easily slides out horizontally (towards the users body) from the underside of the newly supported, and newly configured utility support table 13. In this configuration, the Item 21*a*1 integrated keyboard tray 21*a*1 retains all the adjustability it would normally have if viewed in an embodiment with peripheral systems devices plates 21*a* and mouse pad 21*b*. In this embodiment the integrated keyboard tray 21*a*1 has negative tilt functions. With the addition of the utility support table 13 the overall size and appearance of the apparatus may be greatly reduced while at the same time not detracting in any way from the fundamental ideology or the structural integrity of the apparatus as described for the embodiment shown in FIGS. 1A and 1B. The apparatus retains all of the scalability to its lower and upper portions but is shown to be as minimalistic as possible while achieving the correct ergonomic support, and biomechanics positioning of the human user congruent with the peripheral support devices supported within the alternative embodiment of the apparatus. In this embodiment of the apparatus, the product name is the MacroChair-e, and may be adjusted to fit the different anthropometric body sizes of students between grades 7-12, and may also be used as a solution to the Maximo Chair-e, when only one monitor is needed, or, a smaller footprint is desired by the individual human user.

In a tenth embodiment of the human system interaction apparatus, the structural components that make up the base maybe reduced in size (up to 20%), the chair components that come together to form the ergonomic chair are also reduced in size so as to accommodate the anthropometric body sizes of young children, can be fitted to individuals between grades 1 through 6. The product name of the configuration of this alternative embodiment is the MicroChair-e.

Both the MacroChair-e and the MicroChair-e, may have all systems (computer omponents), integrated into the back of the monitor, thereby reducing the need for additional systems structural components. Both the Macro and MicroChair-e may have an electrically adjustable utility support table 13.

In an eleventh embodiment of the human system interaction apparatus, the apparatus further includes additional VDT structural support frame members 6*a* and 6*b*, shown operable, connected to modified macro hubs 5*a* and 5*b* and joining together the additional VDT structural support frame members 6*a* and 6*b* in such a way as to form a rectangular shape above the user in the user area. The additional VDT structural support frame members 6*a* and 6*b* (assembled together) allows for the placement, and support for additional peripheral systems devices. Micro hubs 7*a* and 7*b* can be placed along entire length of either portion (sides) of the additional VDT structural support frame members 6*a* and 6*b*, and provides scalability for multiple peripheral systems devices placement and support. In this eleventh embodiment, the support of the macro hubs 5*a*, and 5*b* shown generally at the rear of the apparatus, are modified in such a way as to support the additional VDT structural support frame members 6*a* and 6*b* on either side of the now modified assembled. The macro hubs are positioned in front of the user where other devices for supporting additional monitor support arms 8 and VDT monitor 9 may alternatively be employed. A first articulating monitor support arm 8 may be secured directly to the surface of the micro hubs 7*a*, and 7*b*, or directly to the surface of the modified macro hubs. Bolts or clamps may be used to secure the monitor support arms 8 against movement and to further facilitate the securing of the monitor support arms 8 to the micro hubs 7*a* and 7*b* respectively. Any combinations of Items 7*a* and 7*b* can be secured in various strategic positions along portions (sides, fronts) of the additional VDT structural support frame members 6*a* and 6*b* for the desired viewing of multiple VDT monitors 9 by the user in the user area.

A ninth embodiment of the human system interaction apparatus includes the same the primary structural support halves 1*a* and 1*b* and the legs 2*a*, 2*b*, 2*c*, 2*d*. However, it further includes a step 22 operable to receive the respective distal ends of the legs 2*a*, 2*b*, 2*c*, 2*d*, and fitted at the corresponding top corners at the front and rear portions of the step 22. The step 22 permits a user to enter and exit the apparatus by stepping up in to the system, and down out of the system. By raising the entire apparatus it places the monitors above most of the user's head thereby minimizing the effect on the user having to duck while entering in to an environment where multiple monitors are present. The step 22 can be 8 to 10 inches in height and 8 to 10 inches deep and made from any number of materials including, but not exclusive to plastic, poly carbonate resins, carbon fibre, aluminum, glass, acrylics, or any combination shown to have similar structural properties.

In a thirteenth embodiment of the human system interaction apparatus, the primary structural support hub halves 1*a* and 1*b* have been increased in size, and modified so as to provide the structural integrity, and additional room for the integration, and structural support, of any number of electric, or, hydraulic actuators. Shown operable, the actuators attach to the underside of the chair pan mechanism 3*b* and provides dynamic movement (controlled by the software) to the individual human user being supported within the apparatus.

All structural components that are tubular in shape may be made from various materials, including but not exclusive to, aluminum, carbon fiber, chrome-moly, stainless steel plastic, or any other materials that have shown to have similar structural properties All hubs, macro, micro, primary, secondary, utility, or any other hub that provides support to the apparatus may be made from but not exclusive aluminum.

All clamps are may be made from aluminum but can also be made from any number of materials to have shown similar structural properties.

All peripheral systems plates may be made from a variety of materials including but not exclusive to aluminum, carbon fiber, plastic, Plexiglas, glass, or any other light weight material shown to have similar structural properties.

All legs may be made from a variety of materials, including but not exclusive to steel, aluminum, carbon fiber, chrome-moly, or any other materials shown to have similar structural properties.

All aluminum Items (parts) may be anodized.

All Items (parts) made of steel may be finished in either a powder coat, or chrome.

All support tables may be made from a variety of materials including but not exclusive to wood, glass, aluminum, carbon fiber, plastic, Plexiglas, composites, or any other material shown to have similar structural properties.

All rotational motion may be achieved through the use of bearings, ball joints, or by way of direct connection to internally housed pistons.

All vertical motion may be achieved through the use of gas pistons.

All horizontal motion may be achieved through the use of structural support members being of equal or reduced dimensions that insert directly in to other support members and or compression fitting assemblies.

The size of all bolts may be of the M8 standard, and are of corresponding lengths.

The size of all screws maybe of the M4 standard, and are of corresponding lengths.

Elbows may be made out of titanium stainless steel and are to be used in conjunction with straight pieces of carbon fibber pipe as to realize the corners or bends of the pipe.

It will be understood by a person skilled in the art that the dimensions provided herein are provided by way of example only and are not intended to limit the scope of the invention.

It will be also understood by a person skilled in the art that many of the details provided above are by way of example only, and are not intended to limit the scope of the invention which is to be determined with reference to the following claims.

What is claimed is:

1. A peripheral support apparatus for ergonomic positioning of a peripheral device relative to a user, the peripheral support apparatus comprising:

a primary structural hub having legs extending therefrom;

a primary support structure extending upwardly from the primary structural hub so that a distal end thereof is positioned above and behind the user, the distal end of the primary support structure being coupled to a visual display terminal support structure by a macro hub, the visual display terminal support structure extending from the macro hub so that a distal end thereof is positioned in front of the user, a visual display terminal being mounted at the distal end of the visual display terminal support structure and positioned at or above eye-level of the user;

a support arm extending upwardly from the primary structural hub, the support arm having a peripheral systems device plate mounted on a distal end thereof, the peripheral systems device plate being shaped to support a peripheral systems device;

a secondary support structure extending downwardly from the primary structural hub, the secondary support structure being shaped to support a calf of the user and having a foot rest mounted to a distal end thereof; and a primary systems hub which houses a computer is attached to an underside of the primary structural hub, wherein the primary systems hub and the primary structural hub are positioned below the user.

2. The peripheral support apparatus as claimed in claim 1 wherein the primary systems hub is connected to the visual display terminal by a network of cables within the peripheral support apparatus.

3. The peripheral support apparatus as claimed in claim 1 wherein the primary systems hub is connected to the visual display terminal by a wireless system.

4. The peripheral support apparatus as claimed in claim 1 wherein the visual display terminal support structure is adjustable on X, Y and Z axes relative to the user.

* * * * *